US009500007B2

(12) United States Patent
Lambrou et al.

(10) Patent No.: US 9,500,007 B2
(45) Date of Patent: Nov. 22, 2016

(54) LOCK ASSEMBLY

(75) Inventors: Harris Lambrou, Blackburn (AU); Ian Bartos, Blackburn (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 342 days.

(21) Appl. No.: 14/118,715

(22) PCT Filed: May 28, 2012

(86) PCT No.: PCT/AU2012/000596

§ 371 (c)(1),
(2), (4) Date: Jan. 31, 2014

(87) PCT Pub. No.: WO2013/006889

PCT Pub. Date: Jan. 17, 2013

(65) Prior Publication Data

US 2014/0175807 A1 Jun. 26, 2014

(30) Foreign Application Priority Data

Jul. 14, 2011 (AU) ..... 2011902820

(51) Int. Cl.

*E05B 63/00* (2006.01)
*E05B 47/06* (2006.01)
*E05B 47/00* (2006.01)

(52) U.S. Cl.

CPC ..... *E05B 63/0065* (2013.01); *E05B 47/06* (2013.01); *E05B 47/0673* (2013.01); *E05B 47/0012* (2013.01); *E05B 2047/0008* (2013.01); *E05B 2047/0023* (2013.01); *E05B 2047/0067* (2013.01); *E05B 2047/0073* (2013.01); *E05B 2047/0076* (2013.01); *Y10T 292/0908* (2015.04)

(58) Field of Classification Search

CPC ..... E05B 63/0065; E05B 47/06; E05B 47/0673; E05B 47/0012; E05B 2047/0008; E05B 2047/0073; E05B 2047/0076; Y10T 292/0908; Y10T 292/0863; Y10T 292/57

See application file for complete search history.

(56) References Cited

U.S. PATENT DOCUMENTS

| | | | | |
|---|---|---|---|---|
| 2005/0199026 | A1* | 9/2005 | Geringer | E05B 47/0676 70/283 |
| 2010/0031714 | A1 | 2/2010 | Brown et al. | |
| 2010/0213724 | A1* | 8/2010 | Uyeda | E05B 59/00 292/39 |
| 2011/0203331 | A1* | 8/2011 | Picard | E05B 9/02 70/91 |
| 2013/0049380 | A1* | 2/2013 | Armari | E05B 47/0047 292/163 |
| 2014/0008920 | A1* | 1/2014 | Bartos | E05B 47/0004 292/138 |
| 2014/0175810 | A1* | 6/2014 | Lambrou | E05B 47/0661 292/144 |

FOREIGN PATENT DOCUMENTS

| | | |
|---|---|---|
| WO | WO 2011/160161 | 12/2011 |
| WO | WO 2012/006658 | 1/2012 |

* cited by examiner

*Primary Examiner* — Daniel Rohrhoff
(74) *Attorney, Agent, or Firm* — Wood, Phillips, Katz, Clark & Mortimer

(57) ABSTRACT

A lock assembly (20) including a lock bolt (28), a first hub (36), a first electrically powered hub locker assembly (64 to 72) and a first remotely controllable, electrically powered setting mechanism (86 to 112). The lock bolt (28) is movable between a latching position and an unlatching position. The first hub (36) is adapted to move the lock bolt (28) in response to torque being applied to, or movement of, a first handle. The first electrically powered hub locker assembly (64, 66, 68) is settable to operate as fail safe or fail secure. The first remotely controllable, electrically powered setting mechanism (86 to 112) is adapted to set the first electrically powered hub locker assembly (64 to 72) to operate as fail safe in response to a remotely supplied fail safe signal or to operate as fail secure in response to a remotely supplied fail secure signal.

24 Claims, 33 Drawing Sheets

LOCK ASSEMBLY

FIELD OF THE INVENTION

The present invention relates to a lock assembly.

The invention has been developed primarily for use with an electrically controllable and electrically powered mortise lock and will be described hereinafter with reference to this application. However, it will be appreciated that the invention is not limited to this particular use and is also suitable for use in other types of locks, such as surface mounted locks.

BACKGROUND OF THE INVENTION

Electrically controllable and/or electrically powered locks are known. Such locks must be set to operate as either fail safe or fail secure. A fail safe lock automatically reverts to an unlocked state when its power supply is interrupted, for example during a power failure. A fail secure lock automatically reverts to a locked state when its power supply is interrupted.

A disadvantage of such known locks is that the setting as fail safe or fail secure requires manual adjustment of mechanical components in the lock assembly, and usually also requires removal of the lock assembly from the door. Changing the setting of one or more locks in a building is thus a time consuming, laborious and expensive process. As a result, it is impractical to, for example, change a building's configuration daily from a fail safe setting during the day (when occupied) to a fail secure setting at night (when vacant).

OBJECT OF THE INVENTION

It is the object of the present invention to substantially overcome or at least ameliorate the above disadvantage.

SUMMARY OF THE INVENTION

Accordingly, in a first aspect, the present invention provides a lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure; and a first remotely controllable, electrically powered setting mechanism adapted to set the first electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the first remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

The lock assembly preferably includes a first energy storage means adapted to receive and store energy.

The first energy storage means is preferably adapted to receive and store energy before the changing of the setting of the first electrically powered hub locker assembly to operate as fail safe in response to the remotely supplied fail safe signal or to operate as fail secure in response to the remotely supplied fail secure signal. The first energy storage means is preferably adapted to receive and store energy during the changing of the setting of the first electrically powered hub locker assembly to operate as fail safe in response to the remotely supplied fail safe signal or to operate as fail secure in response to the remotely supplied fail secure signal. The first energy storage means is preferably adapted to receive and store energy after the changing of the setting of the first electrically powered hub locker assembly to operate as fail safe in response to the remotely supplied fail safe signal or to operate as fail secure in response to the remotely supplied fail secure signal.

The lock assembly is preferably adapted to release the stored energy in the first energy storage means when power is removed from the lock assembly and use the releasing of the stored energy to drive the first electrically powered hub locker assembly. In addition or alternatively, the lock assembly is preferably adapted to release the stored energy in the first energy storage means in response to an energy release signal and use the released stored energy to drive the first electrically powered hub locker assembly. The released stored energy is preferably used to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

The first energy storage means is preferably adapted to receive mechanical energy and store mechanical energy. Alternatively, the first energy storage means is preferably adapted to receive electrical energy, convert the received electrical energy to mechanical energy and store mechanical energy. The stored mechanical energy is preferably in the form of spring compression.

The first energy storage means is preferably adapted to receive electrical energy and store electrical energy. The stored electrical energy is preferably contained in one or more condensors.

In one form, the first energy storage means includes a spring and the first remotely controllable, electrically powered setting mechanism includes a first driver able to compress the spring. The first remotely controllable, electrically powered setting mechanism is preferably adapted to, when power is removed from the lock assembly and/or in response to an energy release signal, release the compression in the spring and use the released energy in the compressed spring to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

In another form, the first energy storage means includes two springs and the first remotely controllable, electrically powered setting mechanism includes a first driver able to selectively compress one of the two springs. The first remotely controllable, electrically powered setting mechanism is preferably adapted to, when power is removed from the lock assembly and/or in response to an energy release signal, release the compression in one of the two springs and use the released energy in the compressed spring to drive the first electrically powered hub locker assembly to a position preventing movement of the first hub in response to torque being applied to, or movement of, the first handle or release the compression in the other of the two springs and use the released energy in the compressed spring to drive the first electrically powered hub locker assembly to a position allowing movement of the first hub in response to torque being applied to, or movement of, the first handle.

In another form, the first energy storage means includes two springs and the first remotely controllable, electrically powered setting mechanism includes a first driver able to compress both of the two springs. The first remotely controllable, electrically powered setting mechanism is preferably adapted to, when power is removed from the lock assembly and/or in response to an energy release signal, release the compression in one of the two springs and use the released energy in the compressed spring to drive the first electrically powered hub locker assembly to a position preventing movement of the first hub in response to torque being applied to, or movement of, the first handle or release the compression in the other of the two springs and use the released energy in the compressed spring to drive the first electrically powered hub locker assembly to a position allowing movement of the first hub in response to torque being applied to, or movement of, the first handle.

In another form, the first energy storage means includes two springs, each associated with a respective driver that are each able to compress one of the two springs. The drivers are preferably adapted to release the compression in their respective spring, when power is removed from the lock assembly and/or in response to an energy release signal, and the first remotely controllable, electrically powered setting mechanism is adapted to use the released energy in one of the two springs to drive the first electrically powered hub locker assembly to a position preventing movement of the first hub in response to torque being applied to, or movement of, the first handle or use the released energy in the other of the two springs to drive the first electrically powered hub locker assembly to a position allowing movement of the first hub in response to torque being applied to, or movement of, the first handle.

In another form, the first energy storage means includes a spring, associated with a driver able to selectively compress the spring. The driver is preferably adapted to release the compression in the spring, when power is removed from the lock assembly and/or in response to an energy release signal, and the first remotely controllable, electrically powered setting mechanism includes a motion transfer means which can be selectively configured to use the released energy in the spring to drive the first electrically powered hub locker assembly to a position preventing movement of the first hub in response to torque being applied to, or movement of, the first handle or drive the first electrically powered hub locker assembly to a position allowing movement of the first hub in response to torque being applied to, or movement of, the first handle.

The driver(s) is/are preferably a motor(s) or a solenoid(s).

The lock assembly preferably includes:

a second hub adapted to move the lock bolt in response to torque being applied to, or movement of, a second handle;

a second electrically powered hub locker assembly settable to operate as fail safe or fail secure; and a second remotely controllable, electrically powered setting mechanism adapted to set the second electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the second remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

The lock assembly preferably includes a second energy storage means adapted to receive and store energy.

The second energy storage means is preferably adapted to receive and store energy before the changing of the setting of the second electrically powered hub locker assembly to operate as fail safe in response to the remotely supplied fail safe signal or to operate as fail secure in response to the remotely supplied fail secure signal. The second energy storage means is preferably adapted to receive and store energy during the changing of the setting of the second electrically powered hub locker assembly to operate as fail safe in response to the remotely supplied fail safe signal or to operate as fail secure in response to the remotely supplied fail secure signal. The second energy storage means is preferably adapted to receive and store energy after the changing of the setting of the second electrically powered hub locker assembly to operate as fail safe in response to the remotely supplied fail safe signal or to operate as fail secure in response to the remotely supplied fail secure signal.

The lock assembly is preferably adapted to release the stored energy in the second energy storage means when power is removed from the lock assembly and use the releasing of the stored energy to drive the second electrically powered hub locker assembly. In addition or alternatively, the lock assembly is preferably adapted to release the stored energy in the second energy storage means in response to an energy release signal and use the released stored energy to drive the second electrically powered hub locker assembly. The released stored energy is preferably used to drive the second electrically powered hub locker assembly to a position preventing movement of the second hub in response to torque being applied to, or movement of, the second handle when set to operate as fail secure or to a position allowing movement of the second hub in response to torque being applied to, or movement of, the second handle when set to operate as fail safe.

The second energy storage means is preferably adapted to receive mechanical energy and store mechanical energy. Alternatively, the second energy storage means is preferably adapted to receive electrical energy, convert the received electrical energy to mechanical energy and store mechanical energy. The stored mechanical energy is preferably in the form of spring compression.

The second energy storage means is preferably adapted to receive electrical energy and store electrical energy. The stored electrical energy is preferably contained in one or more condensors.

In one form, the second energy storage means includes a spring and the second remotely controllable, electrically powered setting mechanism includes a second driver able to compress the spring. The second remotely controllable, electrically powered setting mechanism is preferably adapted to, when power is removed from the lock assembly, release the compression in the spring and use the released energy in the compressed spring to drive the second electrically powered hub locker assembly to a position preventing movement of the second hub in response to torque being applied to, or movement of, the second handle when set to operate as fail secure or to a position allowing movement of the second hub in response to torque being applied to, or movement of, the second handle when set to operate as fail safe.

In another form, the second energy storage means includes two springs and the second remotely controllable, electrically powered setting mechanism includes a second driver able to selectively compress one of the two springs. The second remotely controllable, electrically powered setting mechanism is preferably adapted to, when power is removed from the lock assembly and/or in response to an energy release signal, release the compression in one of the two springs and use the released energy in the compressed spring to drive the second electrically powered hub locker assembly to a position preventing movement of the second hub in response to torque being applied to, or movement of, the second handle or release the compression in the other of the two springs and use the released energy in the compressed spring to drive the second electrically powered hub locker assembly to a position allowing movement of the second hub in response to torque being applied to, or movement of, the second handle.

In another form, the second energy storage means includes two springs and the second remotely controllable, electrically powered setting mechanism includes a second driver able to compress both of the two springs. The second remotely controllable, electrically powered setting mechanism is preferably adapted to, when power is removed from the lock assembly and/or in response to an energy release signal, release the compression in one of the two springs and use the released energy in the compressed spring to drive the second electrically powered hub locker assembly to a position preventing movement of the second hub in response to torque being applied to, or movement of, the second handle or release the compression in the other of the two springs and use the released energy in the compressed spring to drive the second electrically powered hub locker assembly to a position allowing movement of the second hub in response to torque being applied to, or movement of, the second handle.

In another form, the second energy storage means includes two springs, each associated with a respective driver each able to compress one of the two springs. The drivers are preferably adapted to release the compression in their respective spring, when power is removed from the lock assembly and/or in response to an energy release signal, and the second remotely controllable, electrically powered setting mechanism is adapted to use the released energy in one of the two springs to drive the second electrically powered hub locker assembly to a position preventing movement of the second hub in response to torque being applied to, or movement of, the second handle or use the released energy in the other of the two springs to drive the second electrically powered hub locker assembly to a position allowing movement of the second hub in response to torque being applied to, or movement of, the second handle.

In another form, the second energy storage means includes a spring, associated with a driver able to selectively compress the spring. The driver is preferably adapted to release the compression in the spring, when power is removed from the lock assembly and/or in response to an energy release signal, and the second remotely controllable, electrically powered setting mechanism includes a motion transfer means which can be selectively configured to use the released energy in the spring to drive the second electrically powered hub locker assembly to a position preventing movement of the second hub in response to torque being applied to, or movement of, the second handle or drive the second electrically powered hub locker assembly to a position allowing movement of the second hub in response to torque being applied to, or movement of, the second handle.

The driver(s) is/are preferably a motor(s) or a solenoid(s).

In a second aspect, the present invention provides a lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure;

a first energy storage means adapted to receive and store energy; and a first controllable, electrically powered setting mechanism adapted to set the first electrically powered hub locker assembly to operate as fail safe in response to fail safe signal or to operate as fail secure in response to a fail secure signal, wherein the first electrically powered hub locker assembly is drivable in the absence of power, using the energy stored in the first energy storage means, to a position preventing movement of the first hub in response to torque being applied to, or movement of, the first handle when set to operate as fail secure or to a position allowing movement of the first hub in response to torque being applied to, or movement of, the first handle when set to operate as fail safe.

The first controllable, electrically powered setting mechanism is preferably adapted to set the first electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the first remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

The first energy storage means is preferably adapted to receive and store energy before the changing of the setting of the first electrically powered hub locker assembly to operate as fail safe in response to the remotely supplied fail safe signal or to operate as fail secure in response to the remotely supplied fail secure signal. The first energy storage means is preferably adapted to receive and store energy during the changing of the setting of the first electrically powered hub locker assembly to operate as fail safe in response to the remotely supplied fail safe signal or to operate as fail secure in response to the remotely supplied fail secure signal. The first energy storage means is preferably adapted to receive and store energy after the changing of the setting of the first electrically powered hub locker assembly to operate as fail safe in response to the remotely supplied fail safe signal or to operate as fail secure in response to the remotely supplied fail secure signal.

The lock assembly is preferably adapted to release the stored energy in the first energy storage means when power is removed from the lock assembly and use the releasing of the stored energy to drive the first electrically powered hub locker assembly. In addition or alternatively, the lock assembly is preferably adapted to release the stored energy in the first energy storage means in response to an energy release signal and use the released stored energy to drive the first electrically powered hub locker assembly. The released stored energy is preferably used to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

The first energy storage means is preferably adapted to receive mechanical energy and store mechanical energy. Alternatively, the first energy storage means is preferably adapted to receive electrical energy, convert the received electrical energy to mechanical energy and store mechanical energy. The stored energy is preferably in the form of spring compression.

The first energy storage means is preferably adapted to receive electrical energy and store electrical energy. The stored electrical energy is preferably contained in one or more condensors.

In one form, the first energy storage means includes a spring and the first remotely controllable, electrically powered setting mechanism includes a first driver able to compress the spring. The first remotely controllable, electrically powered setting mechanism is preferably adapted to, when power is removed from the lock assembly and/or in response to an energy release signal, release the compression in the spring and use the released energy in the compressed spring to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

In another form, the first energy storage means includes two springs and the first remotely controllable, electrically powered setting mechanism includes a first driver able to selectively compress one of the two springs. The first remotely controllable, electrically powered setting mechanism is preferably adapted to, when power is removed from the lock assembly and/or in response to an energy release signal, release the compression in one of the two springs and use the released energy in the compressed spring to drive the first electrically powered hub locker assembly to a position preventing movement of the first hub in response to torque being applied to, or movement of, the first handle or release the compression in the other of the two springs and use the released energy in the compressed spring to drive the first electrically powered hub locker assembly to a position allowing movement of the first hub in response to torque being applied to, or movement of, the first handle.

In another form, the first energy storage means includes two springs and the first remotely controllable, electrically powered setting mechanism includes a first driver able to compress both of the two springs. The first remotely controllable, electrically powered setting mechanism is preferably adapted to, when power is removed from the lock assembly and/or in response to an energy release signal, release the compression in one of the two springs and use the released energy in the compressed spring to drive the first electrically powered hub locker assembly to a position preventing movement of the first hub in response to torque being applied to, or movement of, the first handle or release the compression in the other of the two springs and use the released energy in the compressed spring to drive the first electrically powered hub locker assembly to a position allowing movement of the first hub in response to torque being applied to, or movement of, the first handle.

In another form, the first energy storage means includes two springs, each associated with a respective driver that are each able to compress one of the two springs. The drivers are preferably adapted to release the compression in their respective spring, when power is removed from the lock assembly and/or in response to an energy release signal, and the first remotely controllable, electrically powered setting mechanism is adapted to use the released energy in one of the two springs to drive the first electrically powered hub locker assembly to a position preventing movement of the first hub in response to torque being applied to, or movement of, the first handle or use the released energy in the other of the two springs to drive the first electrically powered hub locker assembly to a position allowing movement of the first hub in response to torque being applied to, or movement of, the first handle.

In another form, the first energy storage means includes a spring, associated with a driver able to selectively compress the spring. The driver is preferably adapted to release the compression in the spring, when power is removed from the lock assembly and/or in response to an energy release signal, and the first remotely controllable, electrically powered setting mechanism includes a motion transfer means which can be selectively configured to use the released energy in the spring to drive the first electrically powered hub locker assembly to a position preventing movement of the first hub in response to torque being applied to, or movement of, the first handle or drive the first electrically powered hub locker assembly to a position allowing movement of the first hub in response to torque being applied to, or movement of, the first handle.

The driver(s) is/are preferably a motor(s) or a solenoid(s).

The lock assembly preferably includes:

a second hub adapted to move the lock bolt in response to torque being applied to, or movement of, a second handle;

a second electrically powered hub locker assembly settable to operate as fail safe or fail secure;

a second energy storage means adapted to receive and store energy; and a second controllable, electrically powered setting mechanism adapted to set the electrically powered second hub locker assembly to operate as fail safe in response to fail safe signal or to operate as fail secure in response to a fail secure signal, wherein the second electrically powered hub locker assembly is drivable in the absence of power, using the energy stored in the second energy storage means, to a position preventing movement of the second hub in response to torque being applied to, or movement of, the second handle when set to operate as fail secure or to a position allowing movement of the second hub in response to torque being applied to, or movement of, the second handle when set to operate as fail safe.

The second controllable, electrically powered setting mechanism is preferably adapted to set the second electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the second remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

The second energy storage means is preferably adapted to receive and store energy before the changing of the setting of the second electrically powered hub locker assembly to operate as fail safe in response to the remotely supplied fail safe signal or to operate as fail secure in response to the remotely supplied fail secure signal. The second energy storage means is preferably adapted to receive and store energy during the changing of the setting of the second electrically powered hub locker assembly to operate as fail safe in response to the remotely supplied fail safe signal or to operate as fail secure in response to the remotely supplied fail secure signal. The second energy storage means is preferably adapted to receive and store energy after the changing of the setting of the second electrically powered hub locker assembly to operate as fail safe in response to the remotely supplied fail safe signal or to operate as fail secure in response to the remotely supplied fail secure signal.

The lock assembly is preferably adapted to release the stored energy in the second energy storage means when power is removed from the lock assembly and use the releasing of the stored energy to drive the second electrically powered hub locker assembly. In addition or alternatively, the lock assembly is preferably adapted to release the stored energy in the second energy storage means in response to an energy release signal and use the released stored energy to drive the second electrically powered hub locker assembly. The released, stored energy is preferably used to drive the second electrically powered hub locker assembly to a position preventing movement of the second hub in response to torque being applied to, or movement of, the second handle when set to operate as fail secure or to a position allowing movement of the second hub in response to torque being applied to, or movement of, the second handle when set to operate as fail safe.

The second energy storage means is preferably adapted to receive mechanical energy and store mechanical energy. Alternatively, the second energy storage means is preferably adapted to receive electrical energy, convert the received electrical energy to mechanical energy and store mechanical energy. The stored energy is preferably in the form of spring compression.

The second energy storage means is preferably adapted to receive electrical energy and store electrical energy. The stored electrical energy is preferably contained in one or more condensors.

In one form, the second energy storage means includes a spring and the second remotely controllable, electrically powered setting mechanism includes a second driver able to compress the spring. The second remotely controllable, electrically powered setting mechanism is preferably adapted to, when power is removed from the lock assembly and/or in response to an energy release signal, release the compression in the spring and use the released energy in the compressed spring to drive the second electrically powered hub locker assembly to a position preventing movement of the second hub in response to torque being applied to, or movement of, the second handle when set to operate as fail secure or to a position allowing movement of the second hub in response to torque being applied to, or movement of, the second handle when set to operate as fail safe.

In another form, the second energy storage means includes two springs and the second remotely controllable, electrically powered setting mechanism includes a second driver able to selectively compress one of the two springs. The second remotely controllable, electrically powered setting mechanism is preferably adapted to, when power is removed from the lock assembly and/or in response to an energy release signal, release the compression in one of the two springs and use the released energy in the compressed spring to drive the second electrically powered hub locker assembly to a position preventing movement of the second hub in response to torque being applied to, or movement of, the second handle or release the compression in the other of the two springs and use the released energy in the compressed spring to drive the second electrically powered hub locker assembly to a position allowing movement of the second hub in response to torque being applied to, or movement of, the second handle.

In another form, the second energy storage means includes two springs and the second remotely controllable, electrically powered setting mechanism includes a second driver able to compress both of the two springs. The second remotely controllable, electrically powered setting mechanism is preferably adapted to, when power is removed from the lock assembly and/or in response to an energy release signal, release the compression in one of the two springs and use the released energy in the compressed spring to drive the second electrically powered hub locker assembly to a position preventing movement of the second hub in response to torque being applied to, or movement of, the second handle or release the compression in the other of the two springs and use the released energy in the compressed spring to drive the second electrically powered hub locker assembly to a position allowing movement of the second hub in response to torque being applied to, or movement of, the second handle.

In another form, the second energy storage means includes two springs, each associated with a respective driver that are each able to compress one of the two springs. The drivers are preferably adapted to release the compression in their respective spring, when power is removed from the lock assembly and/or in response to an energy release signal, and the second remotely controllable, electrically powered setting mechanism is adapted to use the released energy in one of the two springs to drive the second electrically powered hub locker assembly to a position preventing movement of the second hub in response to torque being applied to, or movement of, the second handle or use the released energy in the other of the two springs to drive the second electrically powered hub locker assembly to a position allowing movement of the second hub in response to torque being applied to, or movement of, the second handle.

In another form, the second energy storage means includes a spring, associated with a driver able to selectively compress the spring. The solenoid is preferably adapted to release the compression in the spring, when power is removed from the lock assembly and/or in response to an energy release signal, and the second remotely controllable, electrically powered setting mechanism includes a motion transfer means which can be selectively configured to use the released energy in the spring to drive the second electrically powered hub locker assembly to a position preventing movement of the second hub in response to torque being applied to, or movement of, the second handle or drive the second electrically powered hub locker assembly to a position allowing movement of the second hub in response to torque being applied to, or movement of, the second handle.

The driver(s) is/are preferably a motor(s) or a solenoid(s).

In a third aspect, the present invention provides a lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure;

a first controllable, electrically powered setting mechanism adapted to set the first electrically powered first hub locker assembly to operate as fail safe in response to a fail safe signal or to operate as fail secure in response to a fail secure signal;

a first fail safe energy storage means; and a first fail secure energy storage means, wherein, when the first electrically powered hub locker assembly is set to operate as fail safe, the first electrically powered hub locker assembly is drivable using energy stored in the first fail safe energy storage means to a position allowing movement of the first hub in response to torque being applied to, or movement of, the first handle, and/or when the first electrically powered hub locker assembly is set to operate as fail secure, the first electrically powered hub locker assembly is drivable using energy stored in the first fail secure energy storage means to a position preventing movement of the first hub in response to torque being applied to, or movement of, the first handle.

The lock assembly is preferably adapted to release the stored energy in the first fail safe energy storage means or in the first fail secure energy storage means when power is removed from the lock assembly and use the released stored energy to drive the first electrically powered hub locker assembly. In addition or alternatively, the lock assembly is preferably adapted to release the stored energy in the first fail safe energy storage means or in the first fail secure energy storage means in response to an energy release signal and use the released stored energy to drive the first electrically powered hub locker assembly.

The first controllable, electrically powered setting mechanism is preferably adapted to set the first electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the first remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

In one form, energy is receivable and storable in one of the first fail safe energy storage means or the first fail secure energy storage means.

In another form, energy is receivable and storable in both of the first fail safe energy storage means and the first fail secure energy storage means.

The first fail safe energy storage means and the first fail secure energy storage means are preferably adapted to receive mechanical energy and store mechanical energy. Alternatively, the first fail safe energy storage means and the first fail secure energy storage means are preferably adapted to receive electrical energy, convert the received electrical energy to mechanical energy and store mechanical energy. The stored energy is preferably in the form of spring compression.

The first energy storage means is preferably adapted to receive electrical energy and store electrical energy. The stored electrical energy is preferably contained in one or more condensors.

In one form, the first fail safe energy storage means includes a fail safe spring, the first fail secure energy storage means includes a fail secure spring and the first remotely controllable, electrically powered setting mechanism includes a first driver able to selectively compress the fail safe spring and/or the fail secure spring. The first electrically controllable setting mechanism is preferably adapted, when power is removed from the lock assembly and/or in response to an energy release signal, to release the compression in the fail safe spring in order to drive the first electrically powered hub locker assembly to a position allowing movement of the first hub in response to torque being applied to, or movement of, the first handle or release the compression in the fail secure spring in order to drive the first electrically powered hub locker assembly to a position preventing movement of the first hub in response to torque being applied to, or movement of, the first handle.

In another form, the first fail safe energy storage means includes a fail safe spring and a driver able to selectively compress the fail safe spring and the first fail secure energy storage means includes a fail secure spring and another driver able to selectively compress the fail secure spring. The drivers are preferably adapted to release the compression in their respective spring when power is removed from the lock assembly and/or in response to an energy release signal and the first controllable, electrically powered setting mechanism is adapted to use the released energy in the fail safe spring to drive the first electrically powered hub locker assembly to a position allowing movement of the first hub in response to torque being applied to, or movement of; the first handle or use the released energy in the fail secure spring to drive the first electrically powered hub locker assembly to a position preventing movement of the first hub in response to torque being applied to, or movement of, the first handle.

The driver(s) is/are preferably a motor(s) or a solenoid(s).

The lock assembly preferably includes:

a second hub adapted to move the lock bolt in response to torque being applied to, or movement of, a second handle;

a second electrically powered hub locker assembly settable to operate as fail safe or fail secure;

a second controllable, electrically powered setting mechanism adapted to set the second electrically powered hub locker assembly to operate as fail safe or to operate as fail secure;

a second fail safe energy storage means; and a second fail secure energy storage means, wherein, when the second electrically powered hub locker assembly is set to operate as fail safe, the second electrically powered hub locker assembly is drivable using energy stored in the second fail safe energy storage means to a position allowing movement of the second hub in response to torque being applied to, or movement of, the second handle, and/or when the second electrically powered hub locker assembly is set to operate as fail secure, the second electrically powered hub locker assembly is drivable using energy stored in the second fail secure energy storage means to a position preventing movement of the second hub in response to torque being applied to, or movement of, the second handle.

The lock assembly is preferably adapted to release the stored energy in the second fail safe energy storage means or the second fail secure energy storage means when power is removed from the lock assembly and use the released stored energy to drive the second electrically powered hub locker assembly. In addition or alternatively, the lock assembly is preferably adapted to release the stored energy in the second fail safe energy storage means or in the second fail secure energy storage means in response to an energy release signal and use the released stored energy to drive the second electrically powered hub locker assembly.

The second controllable, electrically powered setting mechanism is preferably adapted to set the second electrically powered hub locker assembly to operate as fail safe in response to a remotely supplied fail safe signal or to operate as fail secure in response to a remotely supplied fail secure signal.

The remotely supplied fail safe signal and the remotely supplied fail secure signal are preferably supplied to the second remotely controllable, electrically powered setting mechanism in the form of an electrical signal, a lack of an electrical signal, a fibre optic signal, a lack of a fibre optic signal, electromagnetic radiation, lack of electromagnetic radiation or other. The signal may be generated from a switch, a computer control system or a signal receiver turning a transmitted signal into electrical impulses or other.

In one form, energy is receivable and storable in one of the second fail safe energy storage means or the second fail secure energy storage means.

In another form, energy is receivable and storable in both of the second fail safe energy storage means and the second fail secure energy storage means.

The second fail safe energy storage means and the second fail secure energy storage means are preferably adapted to receive mechanical energy and store mechanical energy. Alternatively, the second fail safe energy storage means and the second fail secure energy storage means are preferably adapted to receive electrical energy, convert the received electrical energy to mechanical energy and store mechanical energy. The stored energy is preferably in the form of spring compression.

The second energy storage means is preferably adapted to receive electrical energy and store electrical energy. The stored electrical energy is preferably contained in one or more condensors.

In one form, the second fail safe energy storage means includes a fail safe spring, the second fail secure energy storage means includes a fail secure spring and the second remotely controllable, electrically powered setting mechanism includes a second driver able to selectively compress the fail safe spring and/or the fail secure spring. The second controllable, electrically powered setting mechanism is preferably adapted, when power is removed from the lock assembly and/or in response to an energy release signal, to release the compression in the fail safe spring in order to drive the second electrically powered hub locker assembly to a position allowing movement of the second hub in response to torque being applied to, or movement of, the second handle or release the compression in the fail secure spring in order to drive the second electrically powered hub locker assembly to a position preventing movement of the second hub in response to torque being applied to, or movement of, the second handle.

In another form, the second fail safe energy storage means includes a fail safe spring and a driver able to selectively compress the fail safe spring and the second fail secure energy storage means includes a fail secure spring and another driver able to selectively compress the fail secure spring. The drivers are preferably adapted to release the compression in their respective spring when power is removed from the lock assembly and/or in response to an energy release signal and the second controllable, electrically powered setting mechanism is adapted to use the releasing of the compression in the fail safe spring to drive the second electrically powered hub locker assembly to a position allowing movement of the second hub in response to torque being applied to, or movement of, the second handle or use the releasing of the compression in the fail secure spring to drive the second electrically powered hub locker assembly to a position preventing movement of the second hub in response to torque being applied to, or movement of, the second handle.

The driver(s) is/are preferably a motor(s) or a solenoid(s).

BRIEF DESCRIPTION OF THE DRAWINGS

Preferred embodiments of the present invention will now be described, by way of examples only, with reference to the accompanying drawings wherein.

DETAILED DESCRIPTION OF THE PREFERRED EMBODIMENTS

Figure 1:
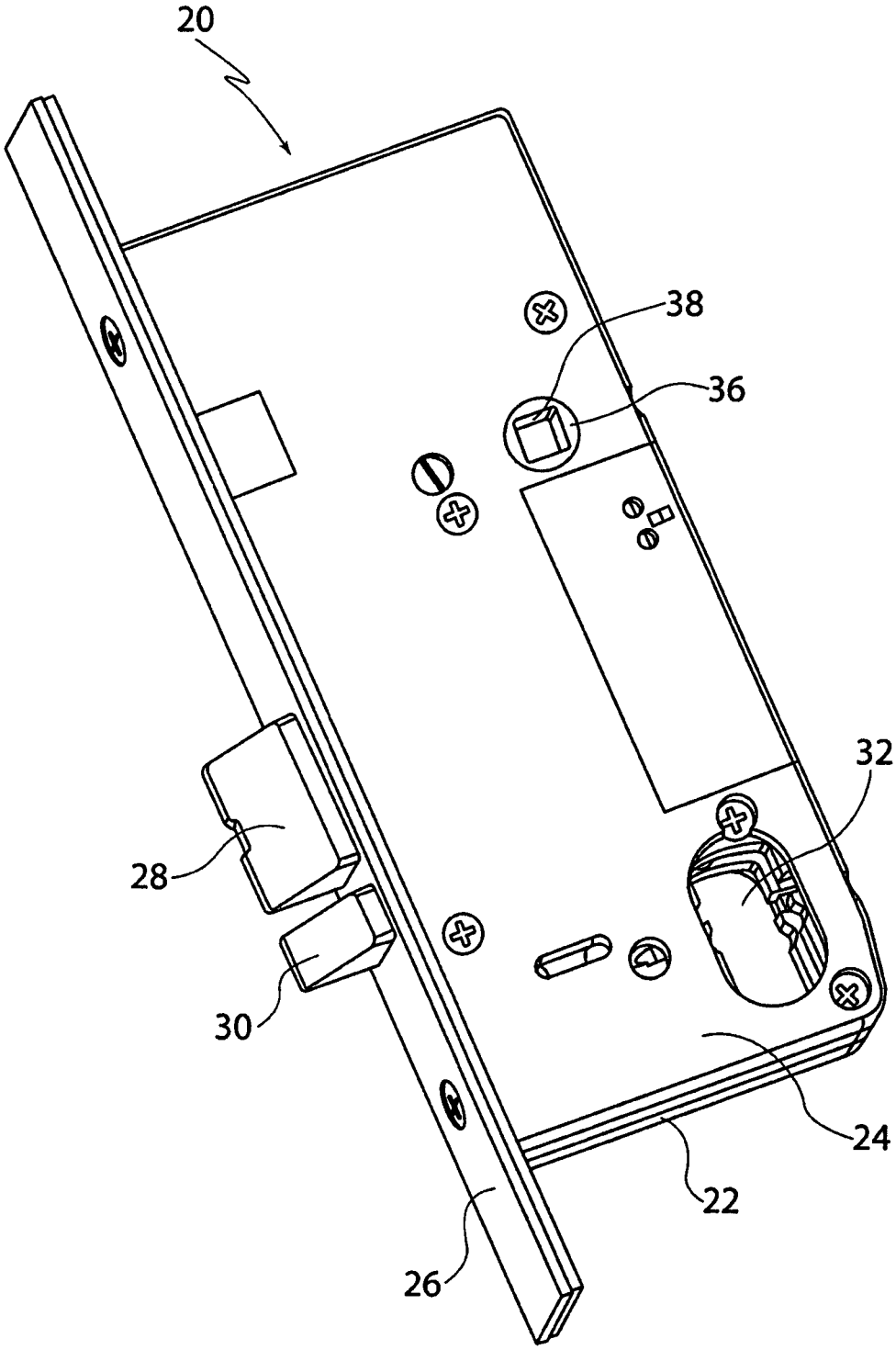
FIG. 1 is a perspective view of a first embodiment a lock assembly.

FIGS. 1 to 15 show a first embodiment of an electrically controllable and electrically powered mortise lock assembly 20. With reference to FIG. 1, the lock assembly 20 includes a housing 22 with a side cover 24 and a face plate 26. The lock assembly 20 is installed in a door with the housing 22 within a mortise void in the door and the face plate 26 adjacent to the non-hinged edge of the door, as is understood by persons skilled in the art. A latch bolt 28 and an auxiliary bolt 30 pass through the faceplate 26 for engagement with a strike plate (not shown) in a door jamb, as is also well understood by persons skilled in the art.

The lock assembly 20 also includes an opening 32 that receives a key cylinder assembly therein (not shown). The key cylinder assembly is retained within the opening 32 with a key cylinder retaining pin (not shown), as is also understood by persons skilled in the art. After the key cylinder has been inserted into the opening 32, and the key cylinder retaining pin inserted into the key cylinder assembly, the key cylinder retaining pin is prevented from releasing its engagement with the key cylinder assembly by engagement of the face plate 26 with the housing 22.

For ease of description, the side of the lock assembly 20 shown in FIG. 1 will be referred to as the first side and the opposite side as the second side. The edge near the faceplate will be referred to as the front and its opposite edge the rear. The edge near the opening 32 will be referred to as the bottom and its opposite edge the top.

The lock assembly 20 also includes a first hub 36 with a square cross section opening 38 therein, which is adapted to engage with a square cross section drive shaft (not shown) of a first external knob, lever or other handle (not shown).

Figure 2:
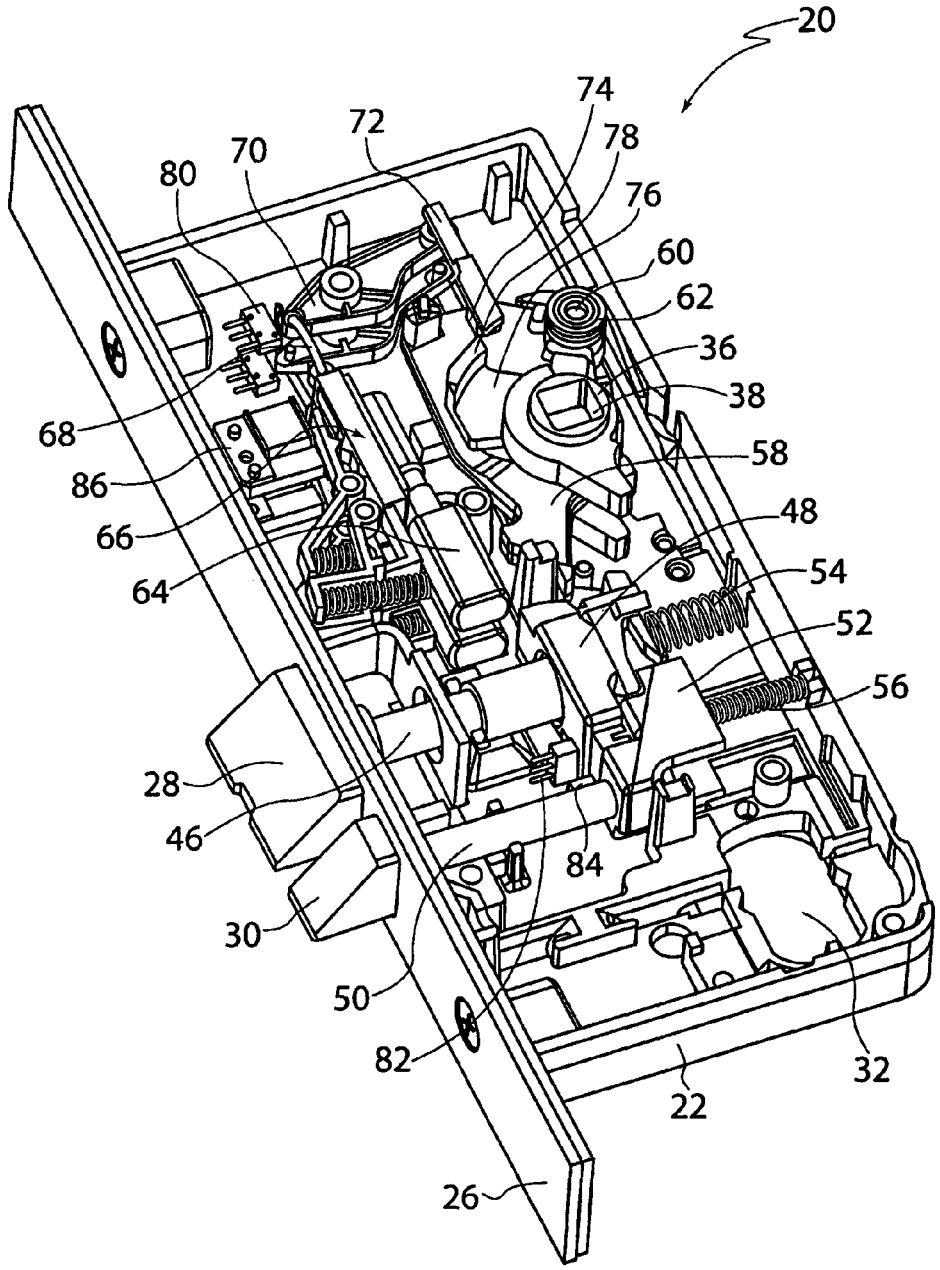
FIG. 2 is a perspective view of the lock assembly shown in FIG. 1 with the side cover removed, set to fail safe and unlocked.

FIG. 2 shows the lock assembly 20 with the side cover 24 of the housing 22 removed. The latch bolt 28 is connected to a latch bolt shaft 46 which is in turn connected to a latch bolt carriage 48. The auxiliary bolt 30 is connected to an auxiliary bolt shaft 50 which is in turn connected to an auxiliary bolt carriage 52. The latch bolt 28 and the auxiliary bolt 30 are biased toward a latching position, as shown in FIG. 2, by a latch spring 54 and an auxiliary latch spring 56 respectively.

A carriage retraction arm 58 is pivotally mounted to the housing 22 by a shaft 60 and biased toward the position shown in FIG. 2 by a spring 62. The arm 58 can be moved to retract the latch bolt 28 and the auxiliary bolt 30 under certain conditions, in response to movement of the first or second handles or the key cylinder assembly, as will be described in more detail below.

FIG. 2 also shows a first electrically powered hub locker assembly comprising a first electrically powered motor 64 which is connected to a first energy storage means, indicated generally by the reference numeral 66, which is in turn connected to one end of a first link 68. The other end of the first link 68 is connected to one end of a first rocker 70. The other end of the first rocker 70 is connected to a first hub locker 72. The first hub locker 72 includes a protuberance 74. The first hub 36 includes a flange 76 carrying a protuberance 78.

FIG. 2 also shows a first hub locking sensor 80 which is able to provide a signal indicative of the position of the first hub locker 72 to allow remote signalling of the lock status of the first hub 36 to a remotely located controller or other internal control. FIG. 2 also shows a latch bolt sensor 82 and an auxiliary bolt sensor 84, which similarly signals the position of the latch bolt 28 and the auxiliary bolt 30 respectively. Other sensors (not shown) can also be added as desired to other mechanical facets of the lock assembly 20, such as remotely signalling lock and/or door status or providing other internal control.

FIG. 2 also shows a first electro magnet 86. The interaction of the first electro magnet 86 with the first energy storage means 66 will be described in more detail below.

Figure 3:
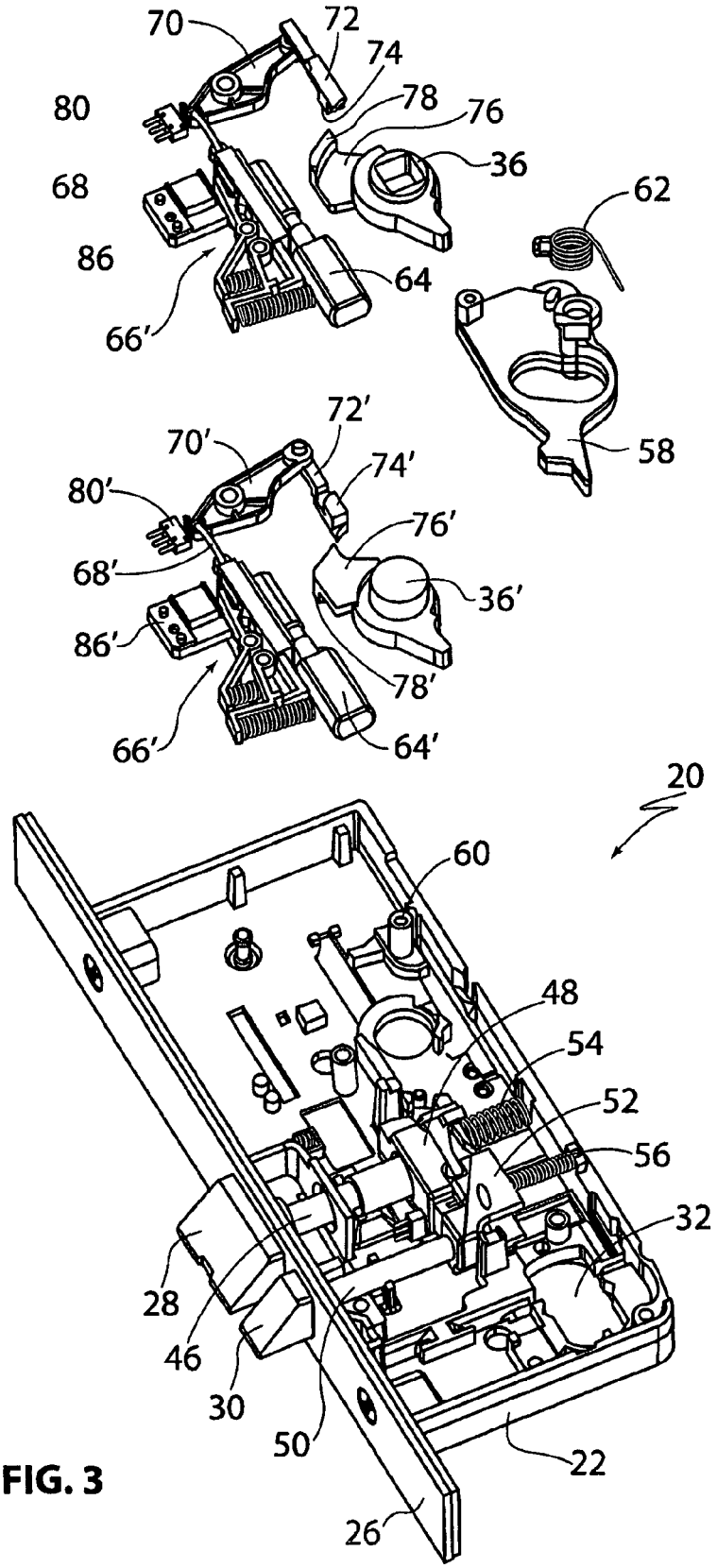
FIG. 3 is an exploded perspective view of the lock assembly shown in FIG. 2.

As best shown in FIG. 3, the second side of the lock assembly 20 includes a second handle (not shown), a second hub 36', a second electrically powered hub locker assembly (similarly comprising a second motor 64', a second energy storage means 66', a second link 68', a second rocker 70' and a second hub locker 72'). The second hub locker 72' similarly includes a protuberance 74'. The second hub 36' similarly includes a flange 76' carrying a protuberance 78'. FIG. 3 also shows a second electro magnet 86' which interacts with the second energy storage means 66'. FIG. 3 also shows a second hub locking sensor 80'. The construction and operation of the second side of the lock assembly 20 is basically the same as the first side.

The lock assembly 20 can be manually unlatched by a key operated manual override function, as is understood by persons skilled in the art. However, for the sake of clarity, the key operated manual override components are not shown. Use of the key operated manual override function pivots the carriage retraction arm 58 to withdraw the lock bolt 28 and the auxiliary bolt 30. This action, known as key override unlatching, withdraws the bolts 28 and 30 for door opening but, importantly, it does not unlock the lock assembly 20. Accordingly, as soon as torque is removed from the key used to rotate the key cylinder assembly, the springs 54 and 56 extend the bolts 28 and 30 respectively and return the lock assembly 20 to a locked configuration.

Figure 4:
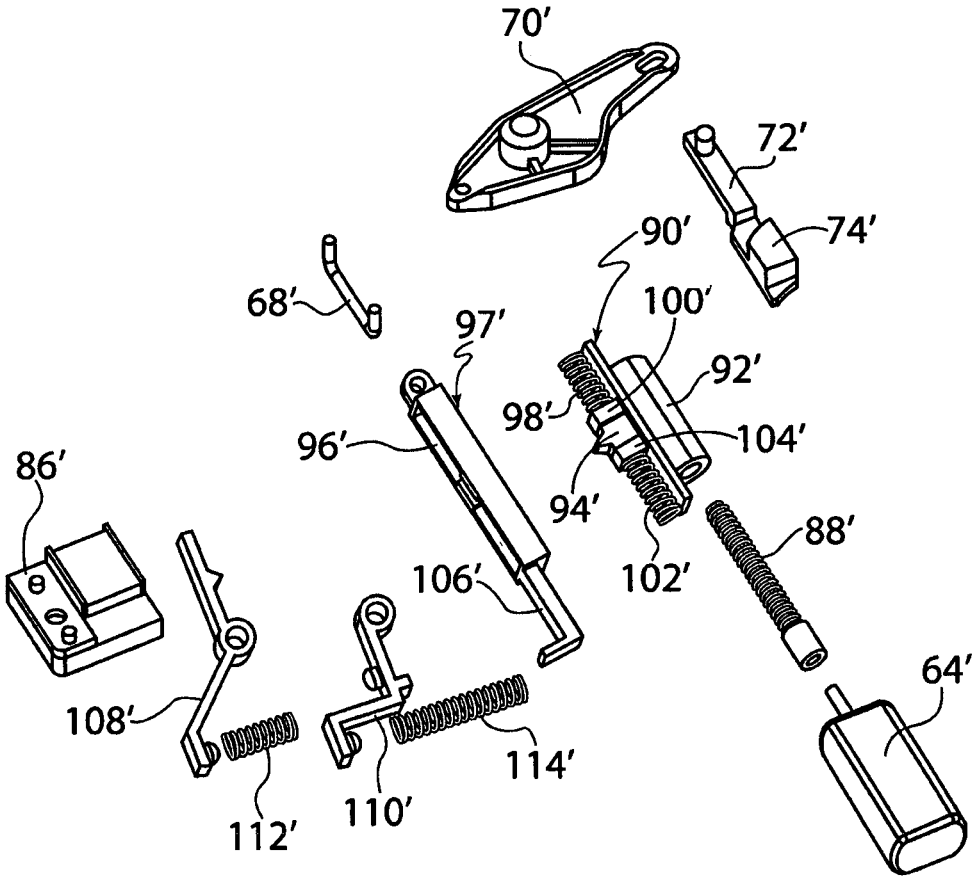
FIG. 4 is an enlarged exploded perspective view of components of the lock assembly shown in FIG. 2.
Figure 5:
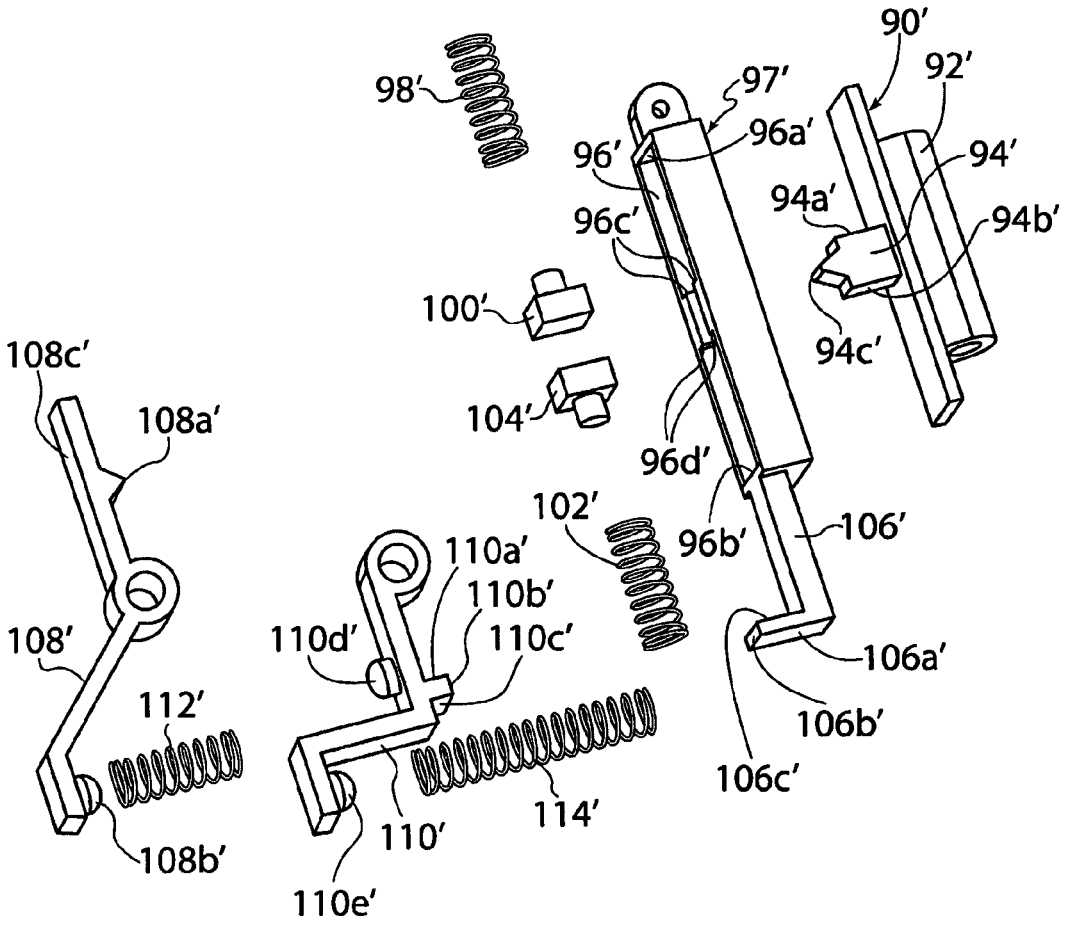
FIG. 5 is an enlarged exploded perspective view of components of the lock assembly shown in FIG. 2.

FIGS. 4 and 5 show components of the second electrically powered hub locker assembly and the second energy storage means 66' in more detail. The motor 64' includes a lead screw 88' which is threadably connected to a slider 90' at a threaded part 92'. The slider 90' also includes a boss 94' which includes a fail secure face **94*a*', a fail safe face 94*b*' and a tip 94*c*'. The boss 94' protrudes through a doubleended, closed channel 96' in a box part 97'. A fail secure spring 98' and a fail secure spring seat 100' are positioned in the channel 96' between an end 96***a*' of the channel 96' and the face 94*a*' of the boss 94'. A fail safe spring 102' and a fail safe spring seat 104' are positioned in the channel 96' between an end 96*b*' of the channel 96' and the face 94*b*' of the boss 94'. The downward movement of the fail secure spring seat 100' in the channel 96' is limited by shoulders 96*c*'. The upward movement of the fail safe spring seat 104' in the channel 96' is limited by shoulders 96*d*'. The fail secure spring 98' and the fail safe spring 102' are of substantially equal spring rate. As best shown in FIG. 5, an L-shaped part 106' extends from the bottom end of the box part 97'. The part 106' includes an unlatched face 106*a*', a fail safe face 106*b*' and a fail secure face 106*c'*.

A latch push 108' and a latch 110' are pivotally mounted to the lock housing 22. The latch push 108' includes a tip 108*a*', a spring seat 108*b*', for one end of a latch push spring 112', and an end 108*c*'. The latch 110' includes an unlatched face 110*a*', a fail safe face 110*b*' and a fail secure face 110*c*'. The latch 110' also includes a spring seat 110*d*' for the other end of the latch push spring 112' and a spring seat 106*e*' for one end of a latch spring 114'. The other end of the latch spring 114' is received in a latch spring recess 116' in the lock housing 22 (see FIG. 6). The latch push spring 112' has a much higher spring rate than the latch spring 114'.

Figure 6:
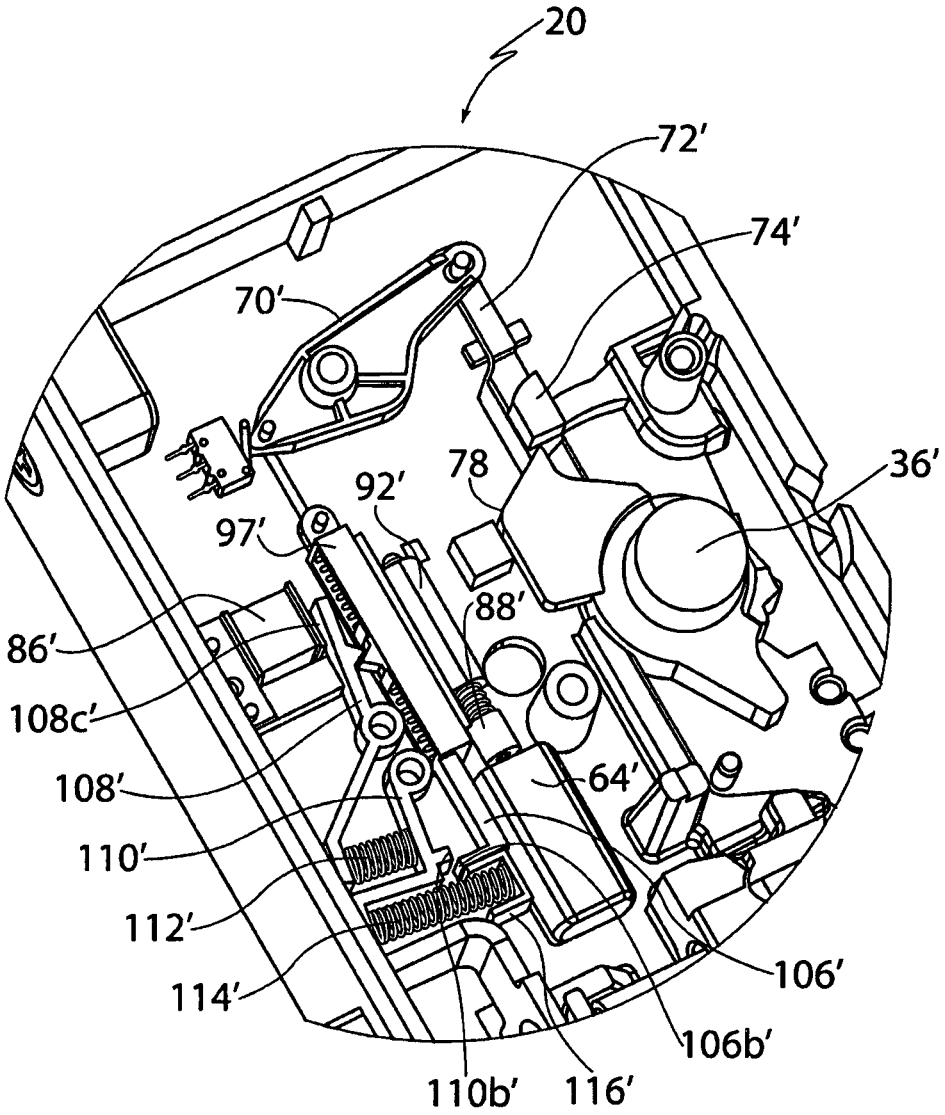
FIG. 6 is a detailed perspective view the lock assembly shown in FIG. 2 in an unlocked configuration.

The operation of the lock assembly 20 shall now be described. FIG. 6 shows the lock assembly 20 set to operate as fail safe and unlocked. The lock assembly 20 is unlocked because the protuberance 74' of the second hub locker 72' is not positioned in abutting engagement with the protuberance 78' of the second hub 36'. Accordingly, when torque is applied to the second handle, the second hub 36' rotates and causes the carriage retraction arm 58 to withdraw the bolts 28 and 30.

The motor 64' can be controlled by electrical signal to rotate the lead screw 88' so as to cause the threaded part 92', and thus the slider 90', to be driven towards or away from the motor 64'. Due to the lead screw thread ratio and the internal gearing of the motor 64', once the slider 90' has been moved to a new position by the motor 64' it remains in that position until further rotation of the motor 64'.

FIG. 6 shows the box part 97' after it has been positioned at the extreme of its travel closest to the motor 64'. As the latch push spring 112' has a much higher spring rate than the latch spring 114', the latch spring 114' is collapsed under the influence of the latch push spring 112'. The latch 110' and the latch push 108' are both thus pivoted in a clockwise direction to the positions shown. As the electromagnet 86' is not energised, the end 108*c*' of the latch push 108' is not held to it. This in turn releases the greater pressure from the latch spring 112' on the latch 110'. As a result, the lesser but adequate urging of the spring 114' causes the latch 110' to pivot clockwise so that the face 110*c*' is clear of the face 106*c*'. The movement of the box part 97' is thus not restrained by the latch 110'. As the box part 97' is connected to the rocker 70' by the link 68', the rocker 70' is pivoted in a counter clockwise direction. This places the second hub locker 72' in a position where it does not prevent movement of the second hub' 36 as previously explained.

Figure 7:
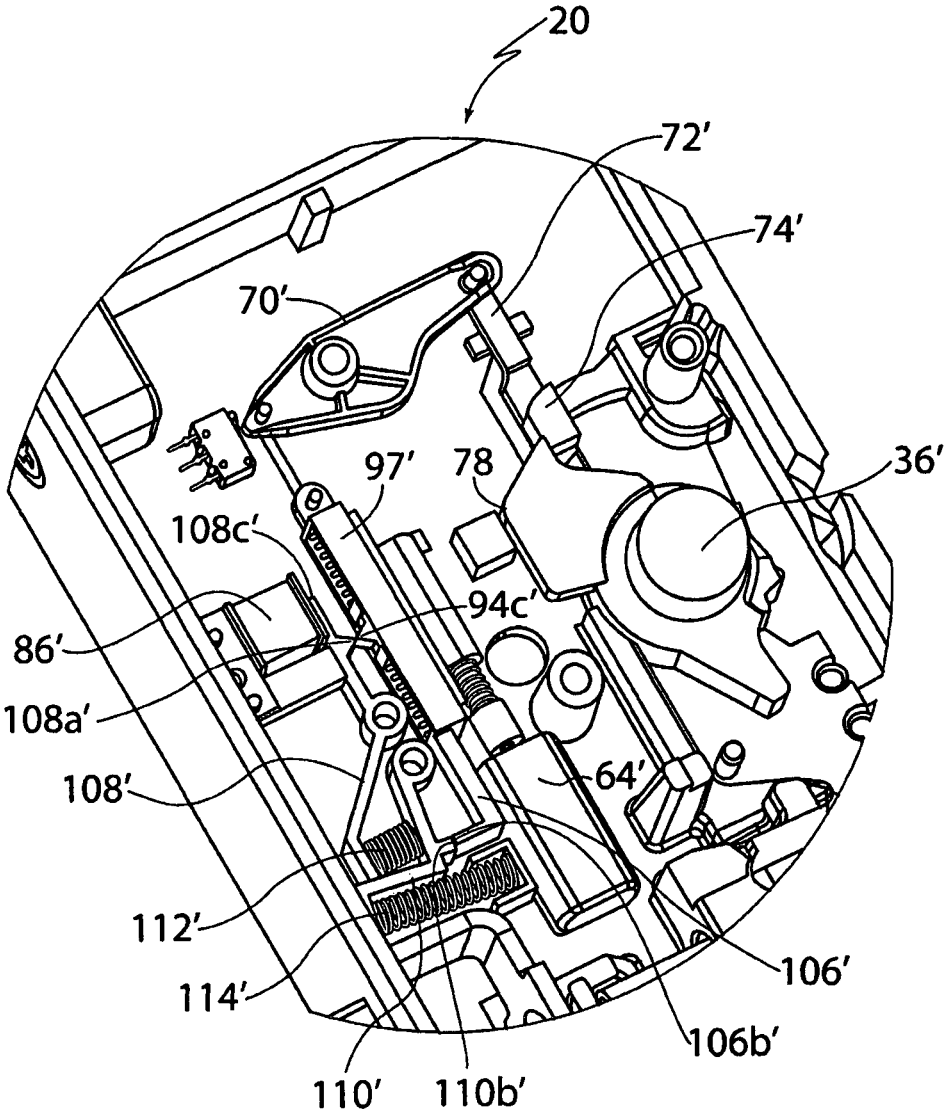
FIG. 7 shows a first sequence of movements required to change the setting of the lock assembly shown in FIG. 6 to fail safe and locked.

FIG. 7 shows the lock assembly 20' after the motor 64' has been rotated to drive the box part 97' away from the motor 64' to a position about half way along its travel. As a result, the face 110*b*' of the latch 110' is adjacent the face 106*b*' of the L-shaped part 106'. Also in this position, the tip 94*c*' of the boss 94' has pushed against the tip 108*a*' of the latch push 108', and caused the latch push 108' to pivot anti clockwise until the end 108*c*' is adjacent the electromagnet 86'. The electromagnet 86' is energised and will retain the end 108*c*', and thus the latch push 108', in the position shown even when the tip 94*c*' has moved away from the tip 108*a*'. As the latch push 108' has pivoted, the latch push spring 112' is compressed. The upward movement of the box part 97' also causes corresponding downward movement in the second hub locker 72' to a position with partial abutting engagement between the protuberances 74' and 78'. For want of a better description, the second side of the lock assembly 20' is now considered 'half locked'. It should be noted that if the power supply to the lock assembly 20 fails in this position there is no internal way of changing the lock assembly 20 to unlocked.

Figure 8:
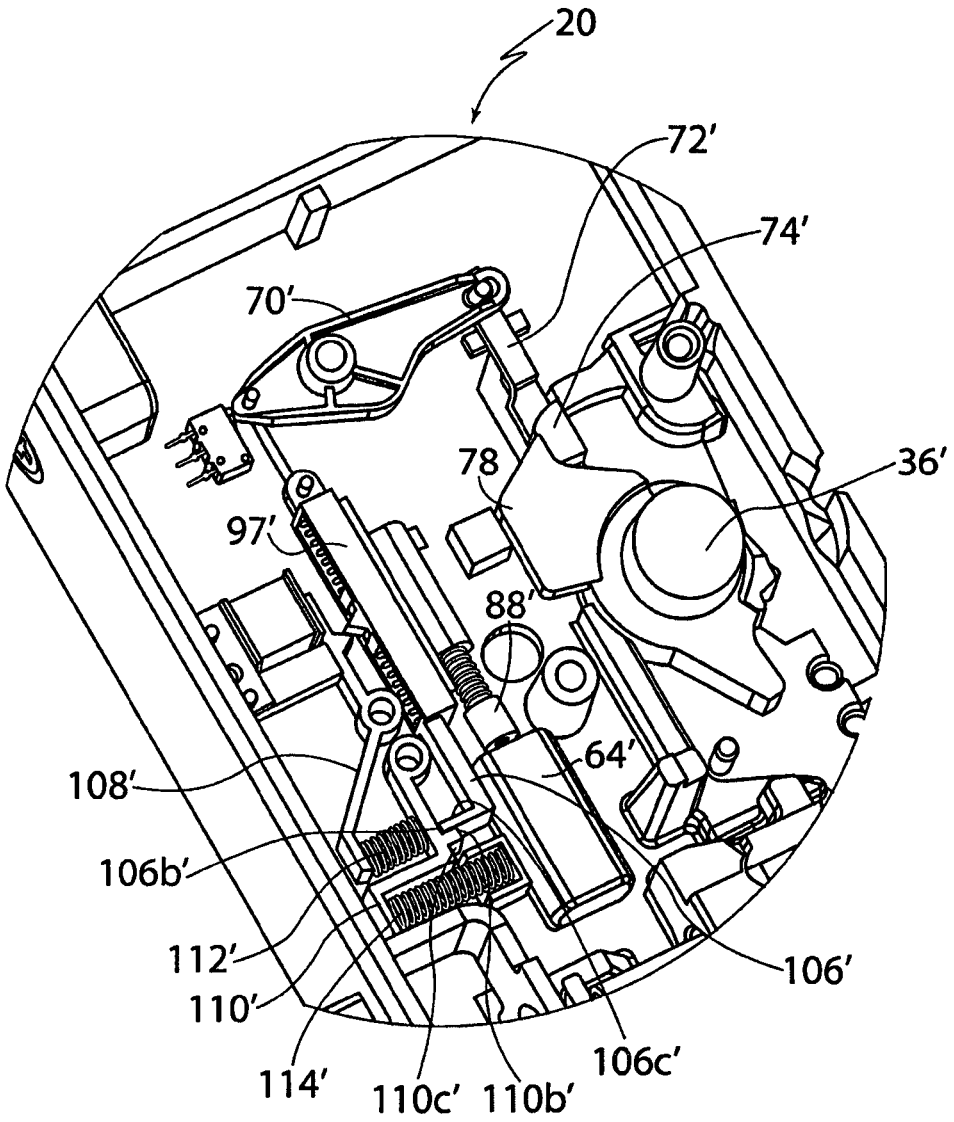
FIG. 8 shows a second sequence of movements required to change the setting of the lock assembly shown in FIG. 6 to fail safe and locked.

FIG. 8 shows the lock assembly 20 after the box part 97' has been driven to the extreme limit of its travel away from the motor 64' by rotation of the lead screw 88'. In this position, the face 110*b*' of the latch 110' is clear of the face 106*b*' of the L-shaped part 106'. The previously described compression of the latch push spring 112' now urges the latch 110' to pivot anti-clockwise. The higher spring rate of the latch push spring 112' overcomes the lower spring rate of the latch spring 114' and causes the latch spring 114' to be compressed as the latch 110' pivots anti-clockwise. The face 110*c*' is now adjacent the face 106*c*' of the L-shaped part 106'. This positioning of the box part 97' causes the second hub locker 72' to be positioned such that there is full abutting engagement between the protuberances 74' and 78'. As a result, the second hub 36' can not be pivoted to withdraw the bolts 28' and 30' and the second side of the lock assembly 20 is now locked. Again, there is no internal way of changing the lock assembly 20' to unlocked should the power fail in this position.

Figure 9:
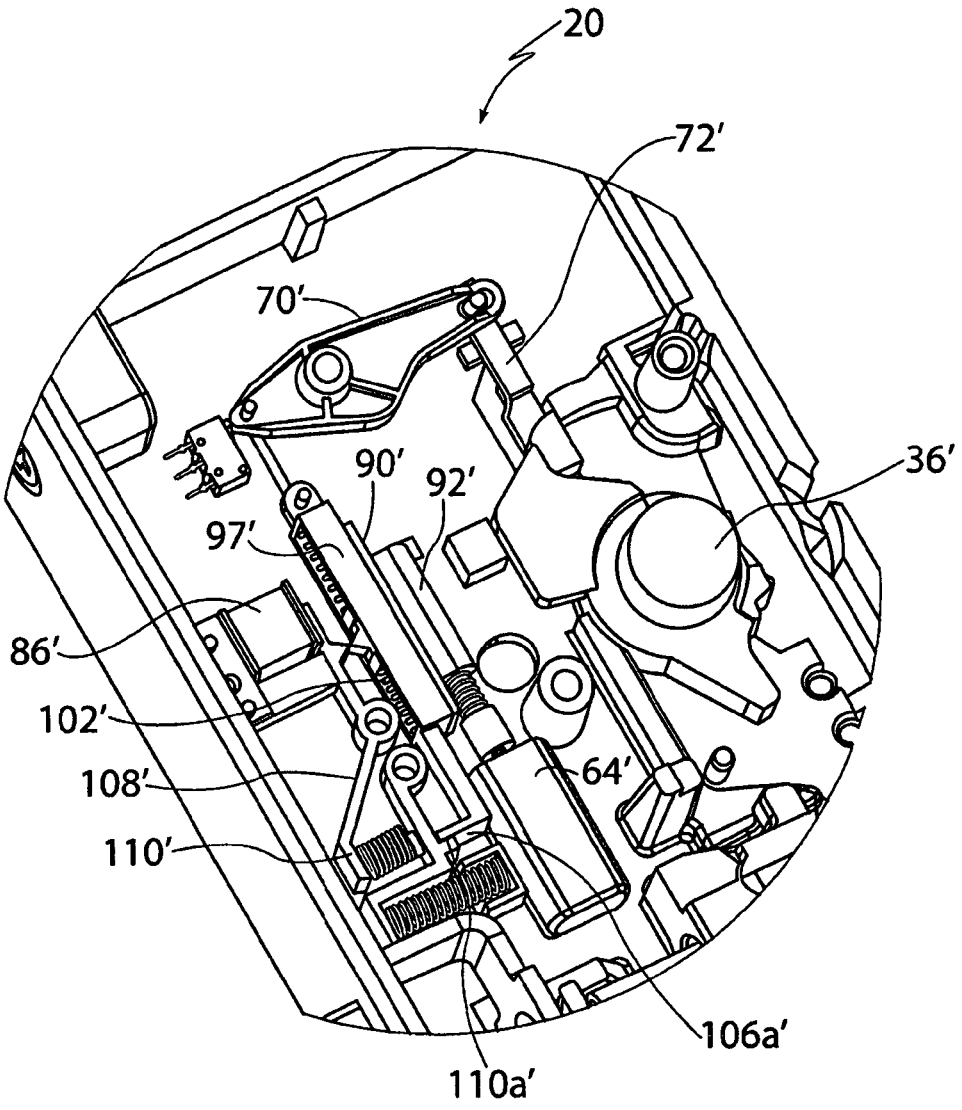
FIG. 9 shows a third sequence of movements required to change the setting of the lock assembly shown in FIG. 6 to fail safe and locked.

FIG. 9 shows the lock assembly 20 after the motor 64' has been rotated to drive the threaded part 92' and thus the slider 90' back towards the motor 64'. The box part 97' is unable to undertake a similar movement due to the face 106*a*' pressing against the face 110*a*'. As a result, the boss 94' is moved towards the motor 64' causing the spring 102' to be compressed. As the position of the box part 97' and thus the second hub locker 36' has not changed, the second side of the lock assembly 20 is still locked. Again, there is no internal way of changing the lock assembly 20 to unlocked should the power fail in this position.

Figure 10:
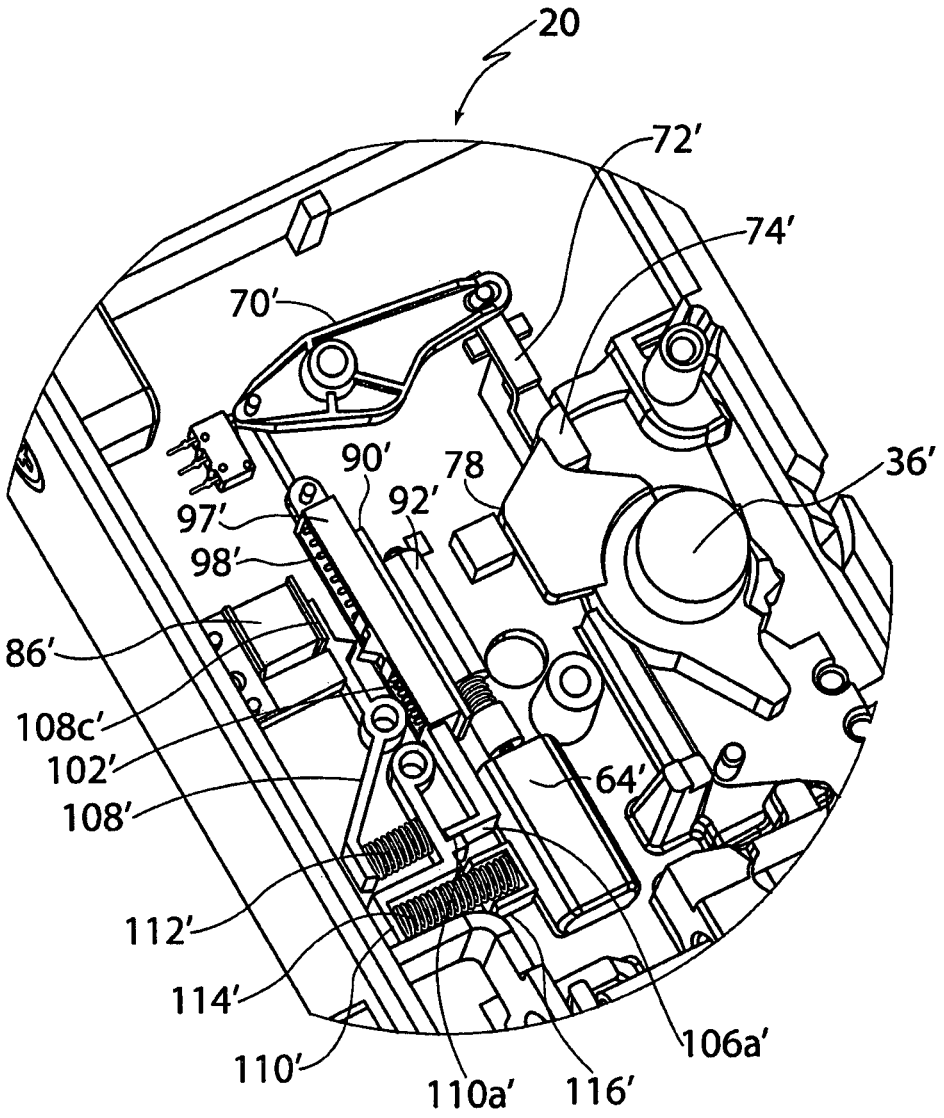
FIG. 10 shows the lock assembly of FIG. 6 after a fourth movement sequences and now set to fail safe and locked.

FIG. 10 shows the lock assembly 20 after the threaded part 92', and thus the slider 90' and the boss 94', have been driven by the motor 64' to the extreme extent of their travel closest to the motor 64'. As with FIG. 9, the box part 97' has not moved, the second hub locker 72' has not moved and the second side of the lock assembly 20 is still locked. This represents a fail safe setting for the second side of the lock assembly 20. The second side of the lock assembly 20 can now be unlocked without requiring power to be applied to the motor 64', as will be described below.

If power is removed from the lock assembly 20 shown in FIG. 10, for example as would occur during a power failure, then power is removed from the electromagnet 86' and it releases the end 108*c*' of the latch push 108' and allows it to pivot in a clockwise direction. The influences of latch push spring 112' and latch spring 114' causes the latch push 108' and the latch 110' to return to the positions shown in FIG. 6. As a result, the face 110*c*' is no longer in abutting engagement with the face 106*c*' and the box part 97' is allowed to move. The springs 98' and 102' cause the box part 97' to recentralise itself around the slider 90' and the boss 94'. This movement causes the box part 97' to move downwardly towards the motor 64' into the position shown in FIG. 6. This causes the rocker 70' to pivot in an anti clockwise direction and raises the second hub locker 72' to a position where there is no abutting engagement between the protuberances 74' and 78'. Accordingly, the second side of the lock assembly 20 is now unlocked and the second hub 36' can be pivotted to withdraw the bolts 28 and 30. This sequence of operations can also be initiated by supplying an energy release signal to the electromagnet 86' causing it to de-energise and release the latch push 108', without otherwise requiring power removal from the lock assembly 20.

The lock assembly 20 can thus be set to fail safe, and/or unlocked, by electrical signal only, as the previously described sequence of operations are all brought about by manipulation of electrical powered/controlled components (i.e. the motor 64' and the electromagnet 86'). The electrical signal can advantageously also be supplied remotely. The setting of the lock assembly 20 as fail safe can thus advantageously be achieved by way of a remotely supplied fail safe electrical signal and, importantly, does not require any: physical access to the lock assembly 20; manual manipulation of lock components; or removal of the lock assembly 20 from the door.

Figure 11:
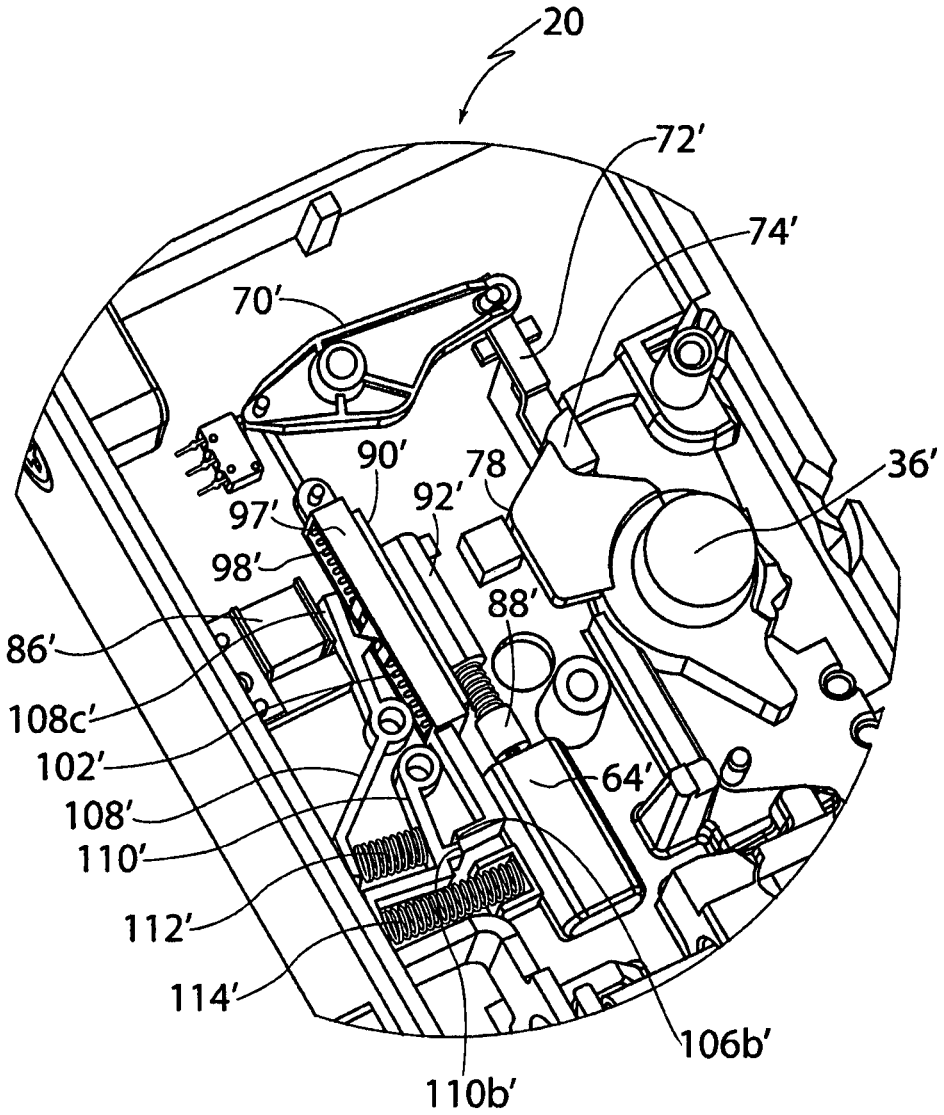
FIG. 11 shows the lock assembly of FIG. 2 in a locked configuration.

FIG. 11 shows the lock assembly 20 set to fail secure and locked with the second hub locker 72' positioned with the protuberance 74' in abutting engagement with the protuberance 78'. As a result, the second hub 36' can not be rotated to withdraw the bolts 28 and 30. In FIG. 11, the motor 64' has been driven to position the slider 90' and thus the box part 97' to the extreme limit of its travel furthest from the motor 64. The electromagnet 86' is not energised and therefore the end 108*c'* of the latch push 108' is not held to it. This in turn has released the greater pressure from the latch push spring 112' on the latch 110'. As a result, and under the lesser but adequate urging from the latch spring 114', the latch 110' pivots clockwise so that the face 106*a'* is clear of the face 110*a'*. As the box part 97' is not restrained by the latch 110', the equal and centralising forces provided by the springs 98' and 102' locate the slider 90' and the boss 94' centrally within the box part 97'.

Figure 12:
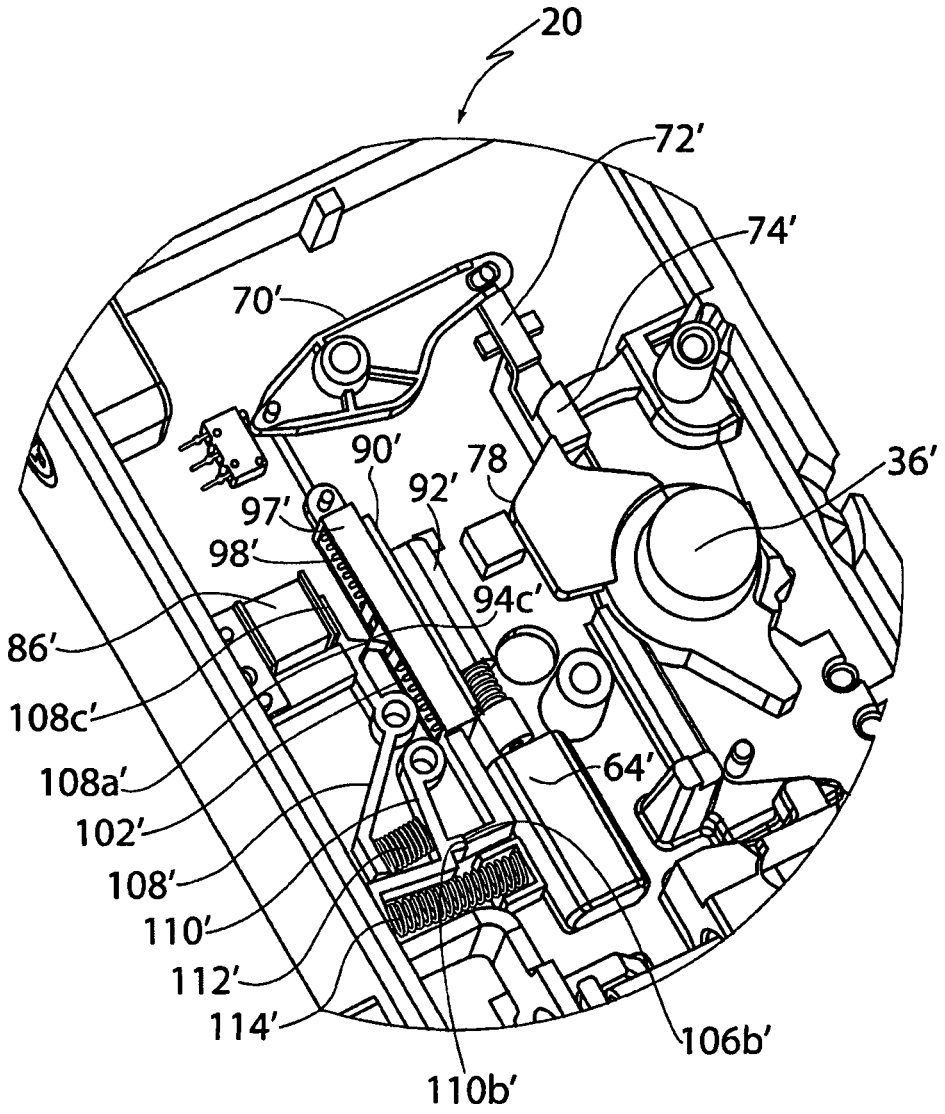
FIG. 12 shows a first sequence of movements required to change from the setting of the lock assembly shown in FIG. 11 to fail secure and unlocked.

FIG. 12 shows the lock assembly 20 after the motor 64' has been rotated to cause the slider 90' and the box part 97' to travel about half way along its travel towards the motor 64'. In this position, the face 110*b'* of the latch 110' is adjacent the face 106*b'* of the L-shaped part 106'. Also in this position, the tip 94*c'* of the boss 94' has pushed against the tip 108*a'* of the latch push 108' causing the end 108*c'* of the latch push 108' to be pressed against the electromagnet 86'. The electromagnet 86' is now energised and therefore retains the latch push 108' in the position shown even when the tip 94*c'* has moved away from the tip 108*a'*. The pivoting movement of the latch push 108' also compresses the latch push spring 112'. However, the latch 110' does not pivot under the spring pressure due to the abutting engagement of the face 110*b'* and the face 106*b'*. Due to the movement of the box part 97', the second hub locker 72' is positioned to cause partial abutting engagement between the protuberances 74' and 78'. The second side of the lock assembly 20 is thus considered half locked. In this position, there is no internal way of changing the lock assembly 20 to locked should the power fail.

Figure 13:
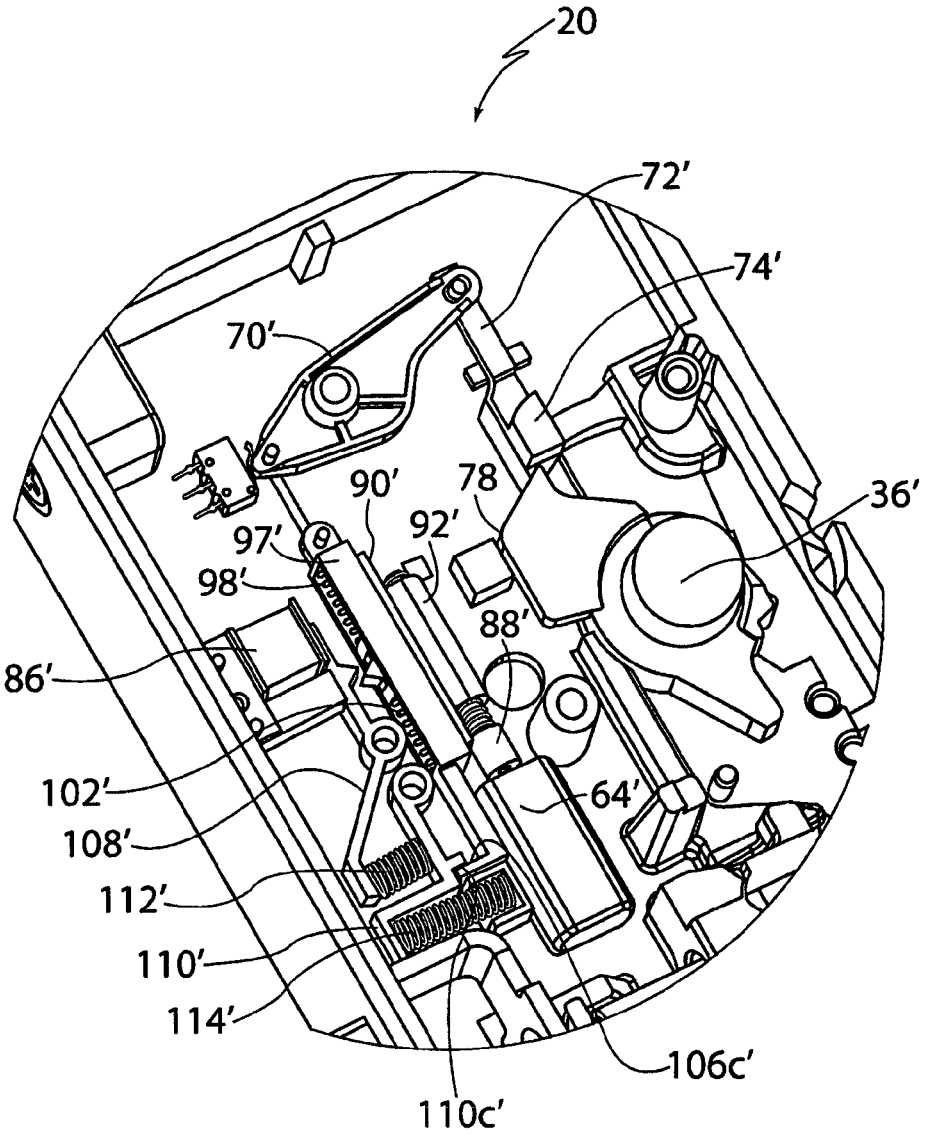
FIG. 13 shows a second sequence of movements required to change the setting of the lock assembly shown in FIG. 11 to fail secure and unlocked.

FIG. 13 shows the lock assembly 20 after further rotation of the motor 64' to draw the slider 90' and the box part 97' further towards the motor 64' into a position at the extreme of its travel closest to the motor 64'. The face 110*b'* is now clear of the face 106*b'* and the latch push spring 112' causes the latch 110' to pivot in a clockwise direction to the position shown with the face 110*c'* in overlapping engagement with the face 106*c'*. The boss 94' and the slider 90' are maintained centralised relative to the box part 97' by the springs 98' and 102'. As a result, the rocker 70' is pivoted so as to raise the hub locker 72' to a position where there is no abutting engagement between the protuberances 74' and 78'. As a result, the second side of the lock assembly 20 is now unlocked and pivoting of the second hub 36' will withdraw the latch bolts 28 and 30. In this position, there is no internal way of changing the lock assembly 20 to locked should the power fail.

Figure 14:
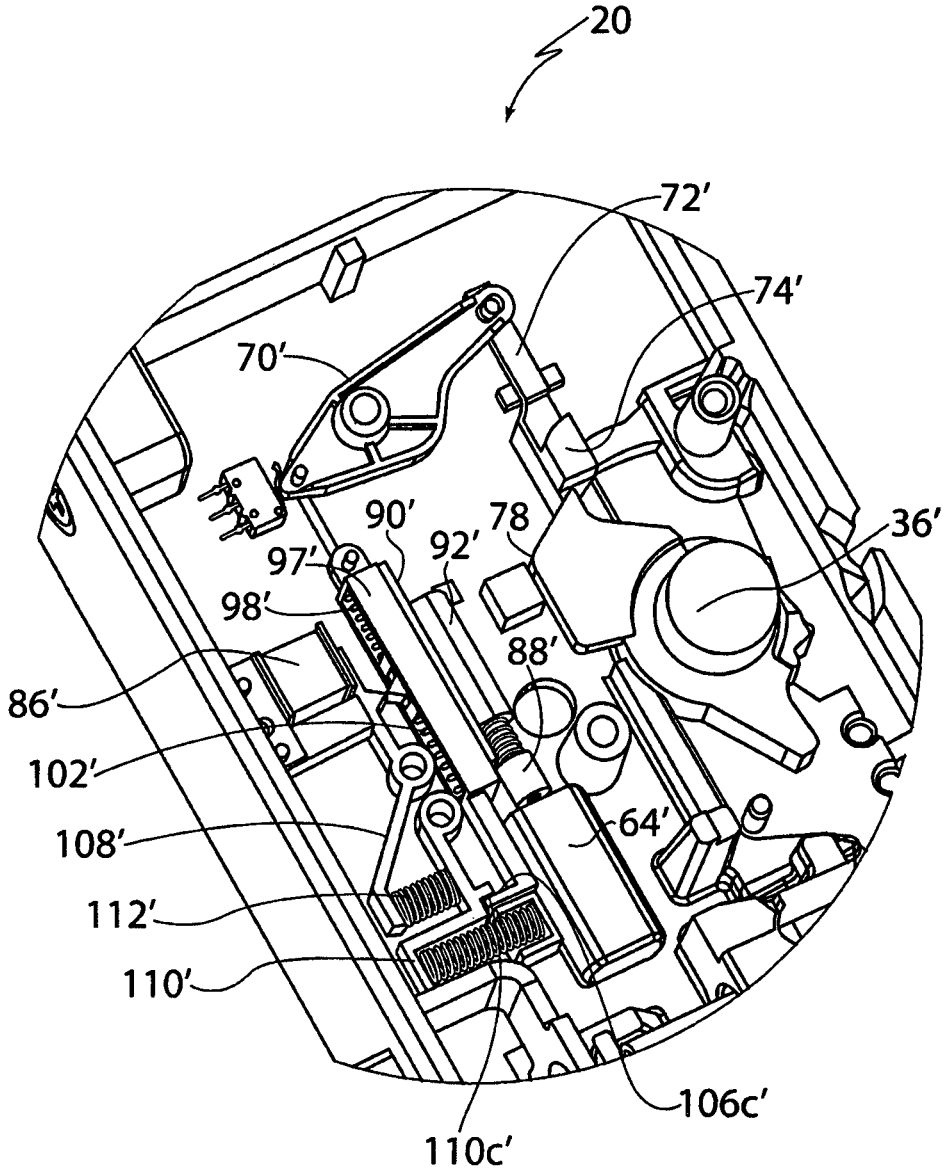
FIG. 14 shows a third sequence of movements required to change the setting of the lock assembly shown in FIG. 11 to fail secure and unlocked.

FIG. 14 shows the lock assembly of FIG. 13 after the motor 64' is driven to rotate the lead screw 88' and cause the slider 90' to be driven away from the motor 64'. The box part 97' does not move relative to the motor 64' during this operation due to the abutting engagement of the face 106*c'* and the face 110*c'*.

Figure 15:
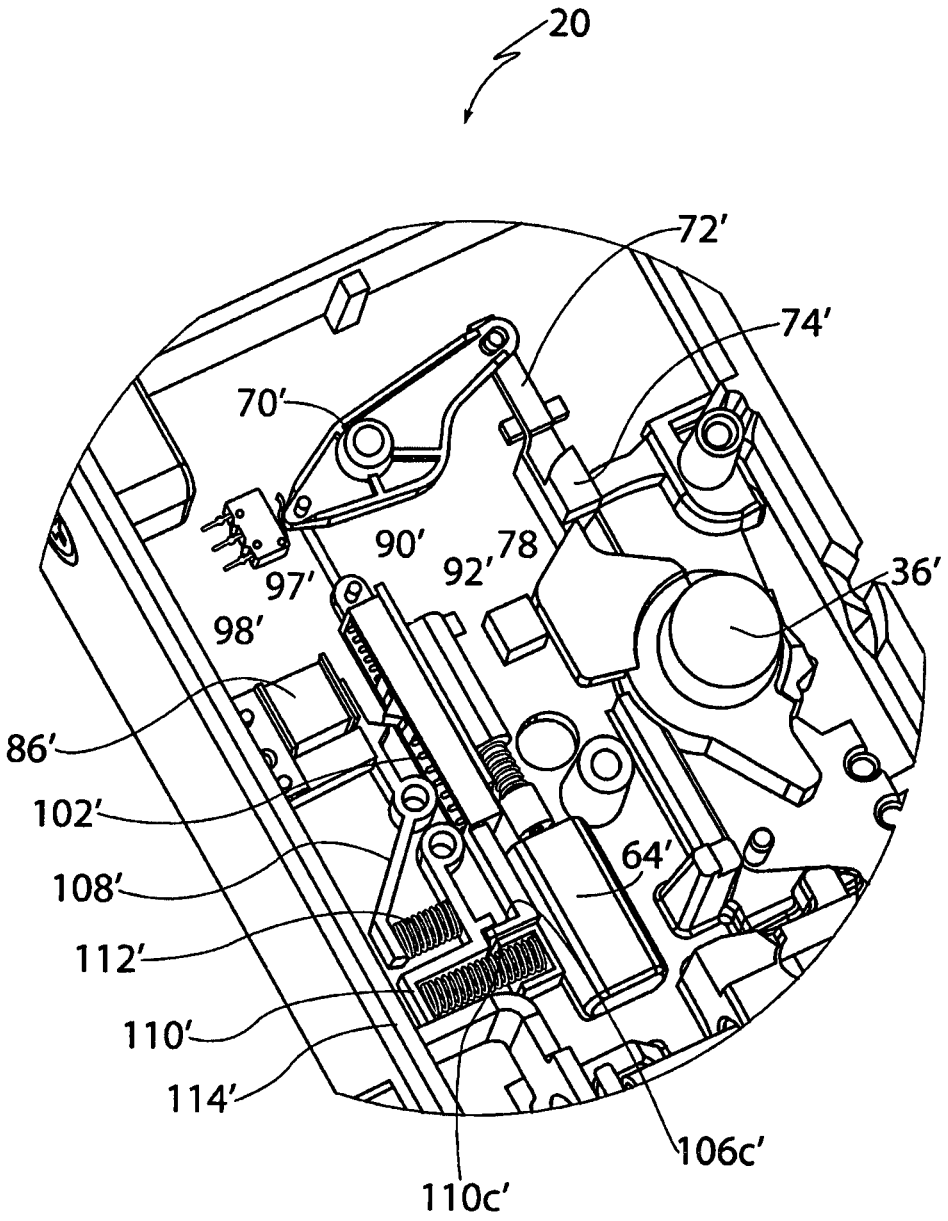
FIG. 15 shows the lock assembly of FIG. 11 after a fourth movement sequence and now set to fail secure and unlocked.

FIG. 15 shows the lock assembly 20 after further movement of the slider 90' in a direction away from the motor 64', which causes compression of the spring 98'. Again there is no movement in the box part 97'. In this position, the second side of the lock assembly 20 is set to fail secure and is able to be locked without any further power needing to be applied to the motor 64'. When power is removed from the electromagnet 86', the latch push 108' is pivoted by the latch push spring 112' in a clockwise direction. This also causes the latch 110' to pivot in a clockwise direction and releases the engagement between the faces 106*c'* and the face 110*c'*. As the box part 97' is no longer restrained, it recentralises around the slider 90' and boss 94' due to the action of the springs 98' and 102'. This movement of the box part 97' causes the hub locker 72' to be driven downwardly such that the protuberances 74' and 78' are in an abutting engagement thereby preventing rotation of the second hub 36'. This locks the second side of the lock assembly 20. This sequence of operations can also be initiated by supplying an energy release signal to the electromagnet 86' causing it to de-energise and release the latch push 108', without otherwise requiring power removal from the lock assembly 20.

The lock assembly 20 can thus be set to fail safe, and/or unlocked, by electrical signal only, as the previously described sequence of operations are all brought about by manipulation of electrical powered/controlled components (i.e. the motor 64' and the electromagnet 86'). The electrical signal can advantageously also be supplied remotely. The setting of the lock assembly 20 as fail safe can thus advantageously be achieved by way of a remotely supplied fail safe electrical signal and, importantly, does not require any: physical access to the lock assembly 20; manual manipulation of lock components; or removal of the lock assembly 20 from the door.

The lock assembly 20 can thus also be set to fail secure, and/or locked, by electrical signal only, as the previously described sequence of operations are all brought about by manipulation of electrical powered/controlled components (i.e. the motor 64' and the electromagnet 86'). The electrical signal can advantageously also be supplied remotely. The setting of the lock assembly 20 as fail secure can thus advantageously be achieved by way of a remotely supplied fail secure electrical signal and, importantly, does not require any physical access to the lock assembly 20, manual manipulation of lock components or removal of the lock assembly 20 from the door.

In summary, the lock assembly 20 is advantageously able to be set as fail safe or as fail secure by electrical signal only. The changes in setting can be instigated remotely or locally.

The ability to remotely set or change the fail safe or the fail secure setting of the lock assembly 20 advantageously allows the fast and relatively inexpensive changing of all or part of a building's doors configuration from a fail safe setting during the day (when occupied) to a fail secure setting at night (when vacant). This obviates the need for physical access to the lock assembly or assemblies. Such changes can be daily or at other intervals.

The ability to locally set or change the fail safe or the fail secure setting of the lock assembly 20, obviates the need for removal of the lock assembly assemblies from their door or doors. This can be performed by manipulating a switch on the lock (eg. under the face plate) or a nearby keyswitch.

FIGS. 16 to 21 show a second embodiment of an electrically controllable and electrically powered mortise lock assembly 120. The lock assembly 120 has several components in common with the previously described lock assembly 20 including the housing 22, the second hub 36' with the protuberance 78', the second motor 64', the second hub locker 72' with the protuberance 74', and the lead screw 88'. The lock assembly 120 also includes two energy storage means in the form of pull type solenoids 122 and 124 that have respective biasing springs 126 and 128. The solenoids 122 and 124 also include respective output shafts 130 and 132 which have larger diameter sections 130*a* and 132*a* and smaller diameter sections 130*b* and 132*b* respectively.

The electrically powered hub locker assembly of the lock assembly 120 includes two double acting (i.e. bi-stable) solenoids 134 and 136 which are each respectively associated with slider blocks 138 and 140 respectively. The slider block 138 includes a pair of openings 138*a* and 138*b* and the slider block 140 includes a pair of openings 140*a* and 140*b*, the function of which shall be described below.

The lock assembly 120 also includes a first rocker 142 which is pivotally mounted to a boss 144 and which interacts with springs 146 and 148. The rocker 142 is connected to another rocker 150 which pivots about a boss 152 which is carried by a threaded part 154 on the lead screw 88. The springs 146 and 148 are of equal spring rate, which is lower than that of the springs 126 and 128.

Figure 16:
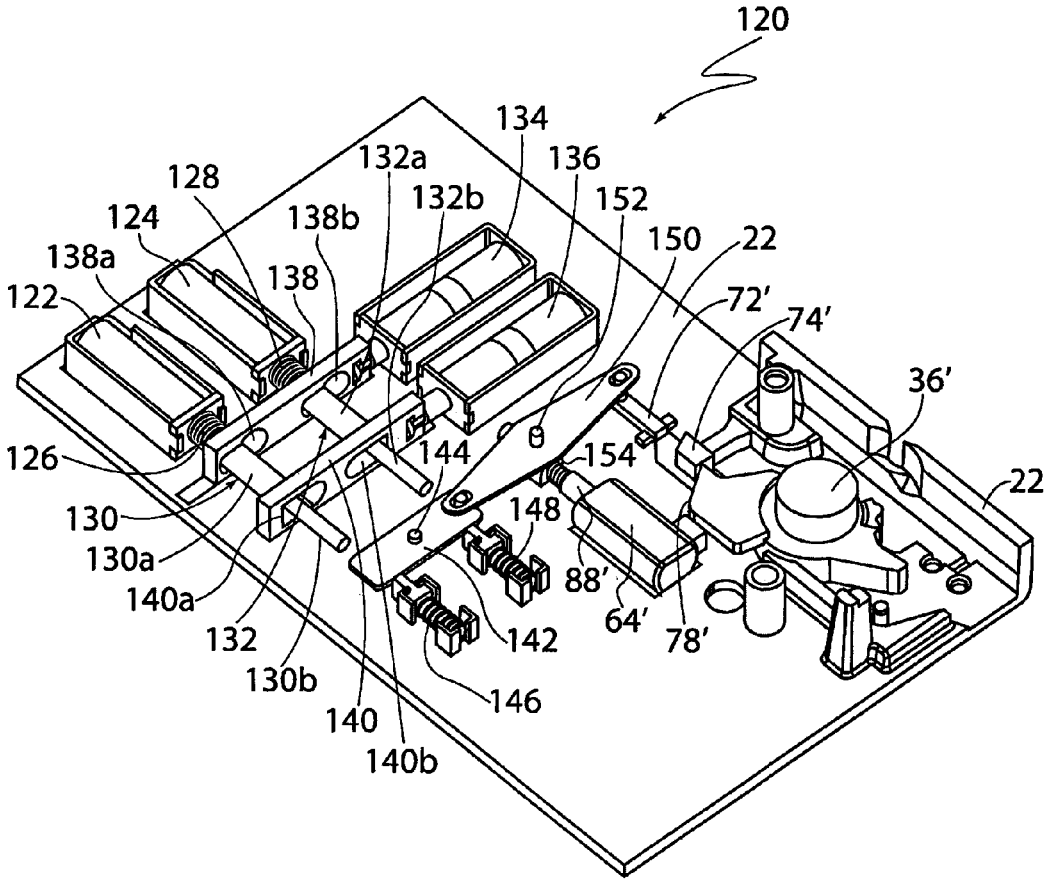
FIG. 16 is a partial perspective view of a second embodiment of a lock assembly in an unlocked configuration.

The operation of the lock assembly 120 shall now be described. FIG. 16 shows the lock assembly 20 unlocked with the protuberances 74' and 78' not in abutting engagement and the second hub 36' being able to be pivoted for bolt retraction. The lock assembly 120 is unable to fail to a locked condition, in response to power failure or an energy release signal, with the components positioned as shown.

Figure 17:
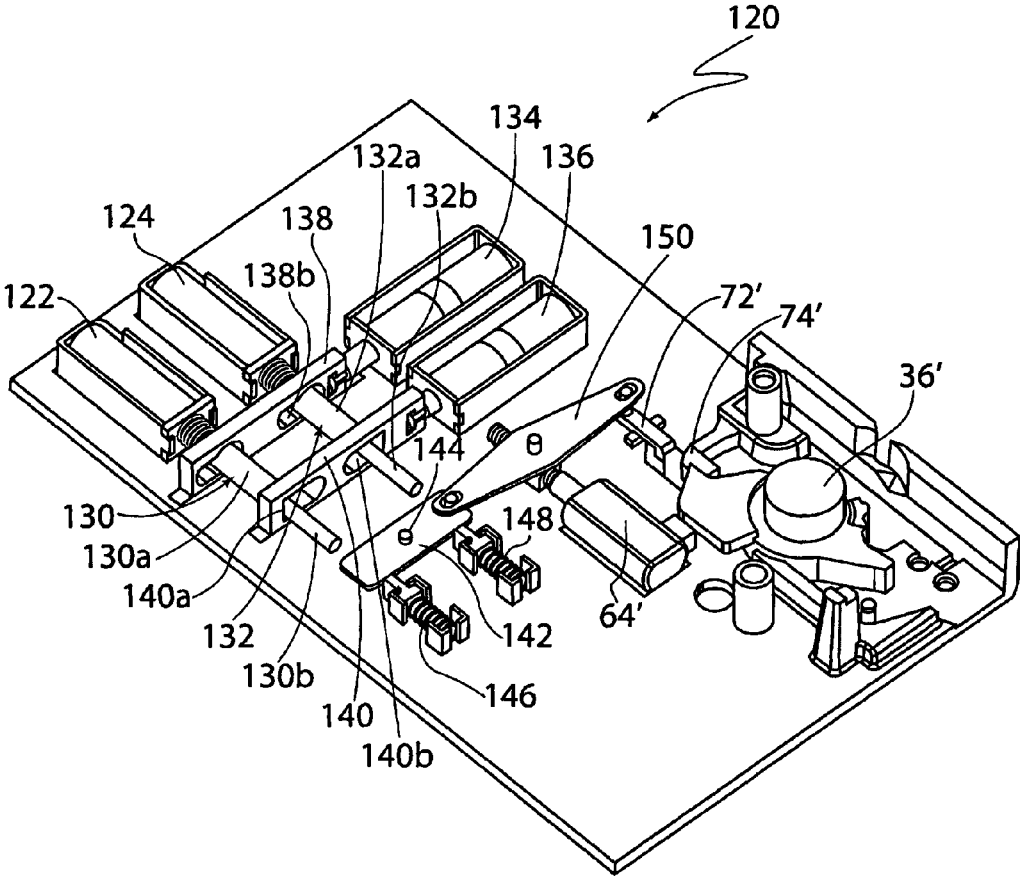
FIG. 17 is a partial perspective view of the lock assembly of FIG. 16 set to fail safe and locked.

FIG. 17 shows the lock assembly 120 locked and set to fail safe. The motor 64' has been driven to lower the boss 152 and thus pivot the rocker 150 clockwise. This lowers the hub locker 72' and places the protuberances 74' and 78' in abutting engagement. The second hub 36' is thus not able to be pivoted for bolt retraction. The solenoids 122 and 124 are energised and thus the respective shafts 130 and 132 are retracted. The solenoid 134 is extended to drive the slider block 138 to a forward position and the solenoid 136 is extended to drive the slider block 140 to a forward position. In these positions, the openings 138*a* and 138*b* in the slider block 138 allow movement of the shaft wider parts 130*a* and 132*a* therethrough. The opening 140*a* in the slider block 140 prevents movement of the shaft 130 from the position shown by not allowing the wider part 130*a* to pass therethrough. The opening 140*b* allows movement of the wider part 132*a* of the shaft 132 therethrough.

Figure 18:
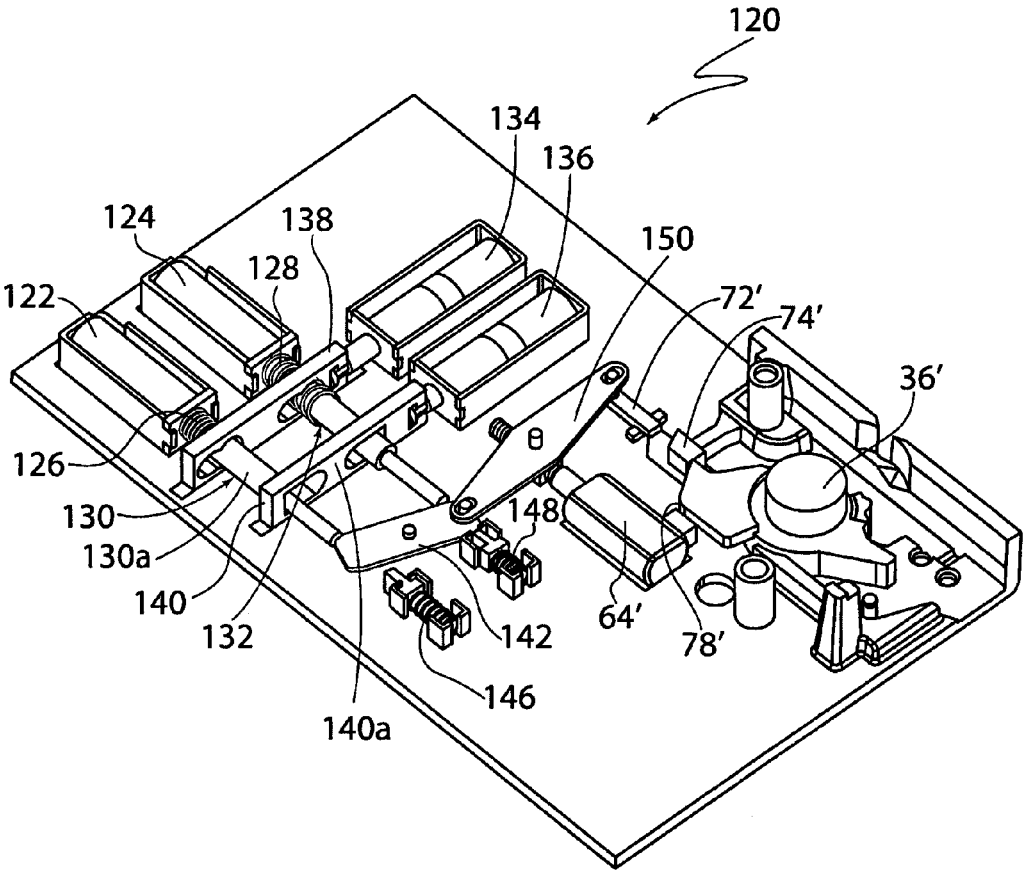
FIG. 18 is a partial perspective view of the lock assembly of FIG. 17 after movement to an unlocked configuration.

FIG. 18 shows the lock assembly 120 after a power failure (or the supply of an energy release signal thereto). As the solenoids 122 and 124 are no longer energised, the respective shafts 130 and 132 attempt to extend under the influence of the springs 126 and 128 respectively. The shaft 132 associated with the solenoid 122 does not move due to it being restrained by the opening 140*a* in the slider block 140. The shaft 132 associated with the solenoid 124 extends under the influence of the spring 128 and pivots the rocker 142 in a clockwise direction. This in turn causes the rocker 150 to rotate in an anti-clockwise direction which raises the hub locker 72' to a position where there is no abutting engagement between the protuberances 74' and 78'. Accordingly, the hub 36' is now free to pivot and the lock assembly 120 is unlocked.

Figure 19:
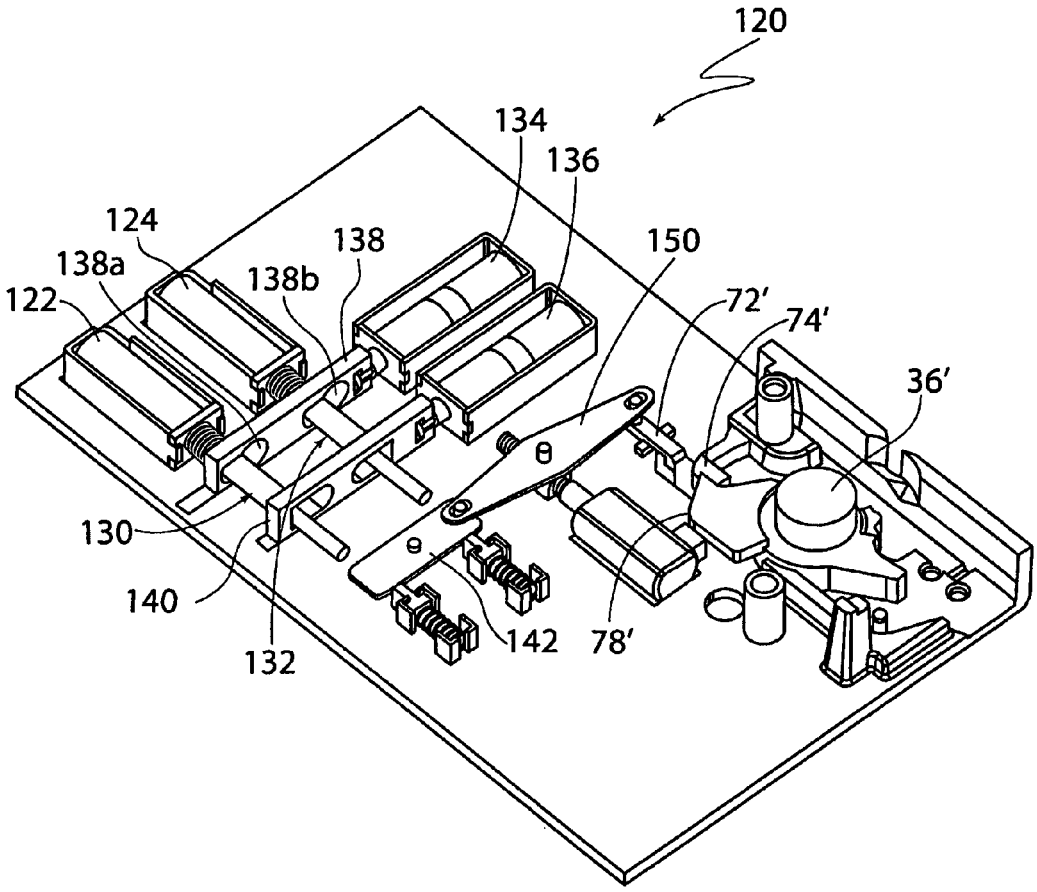
FIG. 19 is a partial perspective view of the lock assembly of FIG. 16 in a locked configuration.

FIG. 19 shows the lock assembly 20 locked (i.e. with the protuberances 74' and 78' in abutting engagement). The solenoids 122 and 124 are energised and thus the respective shafts 130 and 132 are retracted. The solenoid 134 retracts the slider 138 to a rearward position in which its openings 138*a* and 138*b* prevent movement of the shafts 130 and 132 associated with the solenoids 122 and 124 respectively. As a result, the lock assembly 20 is unable to be unlocked by power failure or energy release signal.

Figure 20:
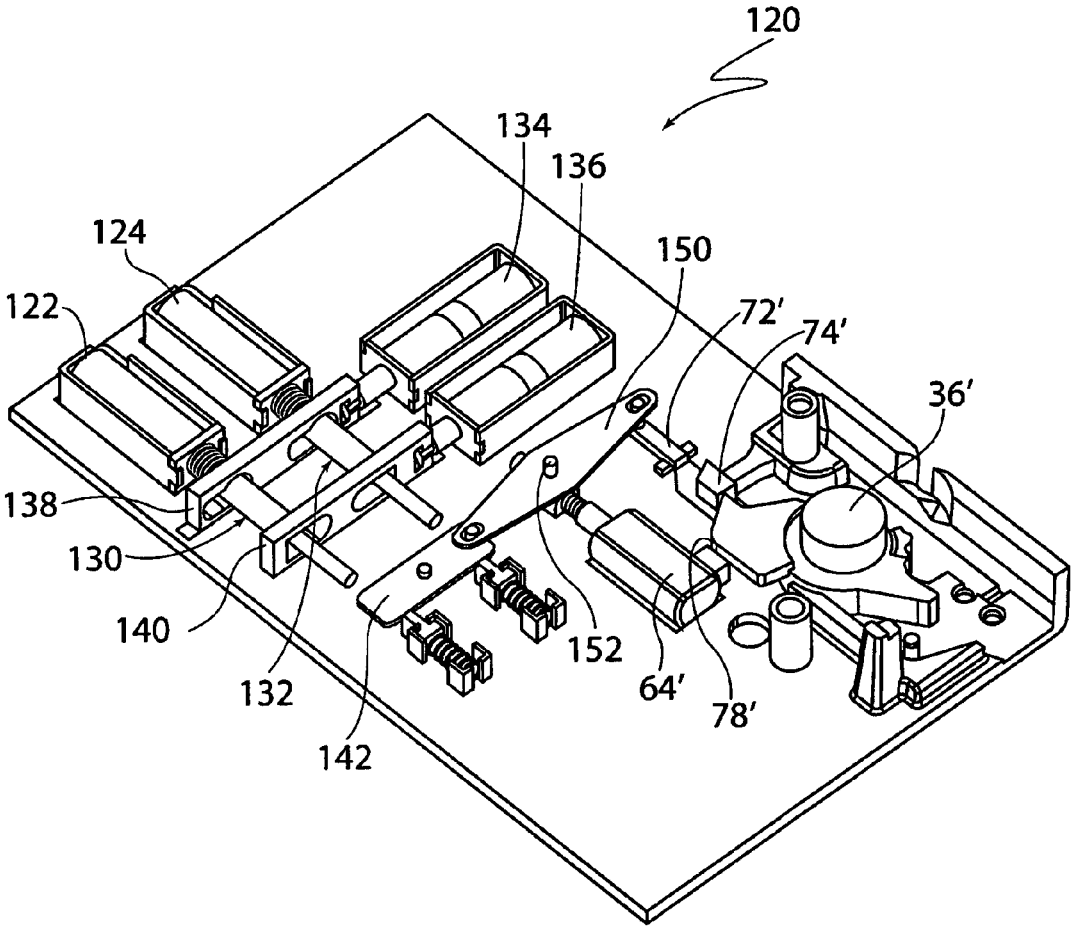
FIG. 20 is a partial perspective view of the lock assembly of FIG. 19 set to fail secure and unlocked.

FIG. 20 shows the lock assembly 120 unlocked by the raising of the boss 152 by the motor 64' which pivots the rocker 150 in an anti-clockwise direction and raises the hub locker 72' so that there is no abutting engagement between the protuberances 74' and 78'. The solenoid 134 extends the slider 138 to its forward position allowing movement of the shafts 130 and 132. The solenoid 136 also extends the rocker 140 to its forward position allowing movement of the shaft 130 but preventing movement of shaft 132. This places the lock assembly 120 in a fail secure setting.

Figure 21:
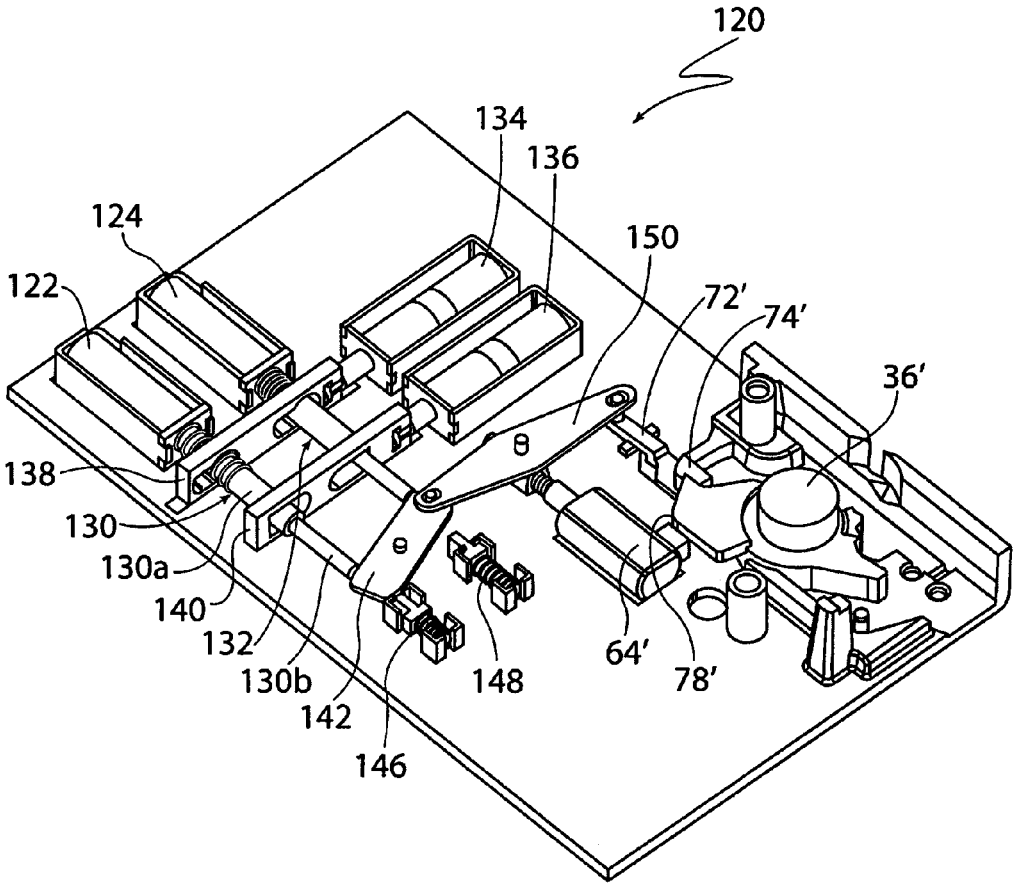
FIG. 21 is a partial perspective view of the lock assembly of FIG. 20 after movement to a locked configuration.

FIG. 21 shows the lock assembly 120 of FIG. 20 after power failure or an energy release signal. As the solenoids 122 and 124 are no longer energised, the respective shafts 130 and 132 attempt to extend under the influence of the springs 126 and 128 respectively. The shaft 132 can not extend due to the position of the opening 140*b* in the slider block 140. The extension of the shaft 130 by the spring 126 pivots the rocker 142 in an anti-clockwise direction. This movement in turn pivots the rocker 150 in a clockwise direction and drives the hub locker 72' downwards such that the protuberances 74' and 78' are in an abutting engagement. This locks the hub 36.

As with the lock assembly 20, the lock assembly 120 can advantageously be set to fail secure, set to fail safe, locked, and unlocked by electrical signal only, as the previously described sequences of operations are all brought about by manipulation of electrical powered/controlled components (e.g. energise or de-energise solenoids). The electrical signal can be supplied remotely or locally.

FIGS. 22 to 27 show a third embodiment of an electrically controllable and electrically powered mortise lock assembly 220. The lock assembly 220 has several components in common with the previously described lock assembly 120 which are indicated with like reference numerals. The lock assembly 220 includes a single pull type solenoid 222 with a biasing spring 224. The solenoid 22 acts upon a H-shaped driver 226, which has a leg 226*a* and a leg 226*b*. The solenoid 134 acts upon a driver positioning slider 228 which can position the driver 226 in a forward (e.g. FIG. 22) or a rearward (e.g. FIG. 23) position. The solenoid 136 acts upon a blocking slider 230, which has a protuberance 230*a*. The lock assembly 220 also includes a rocker 232, which has an extension 232*a* and an extension 232*b*.

Figure 22:
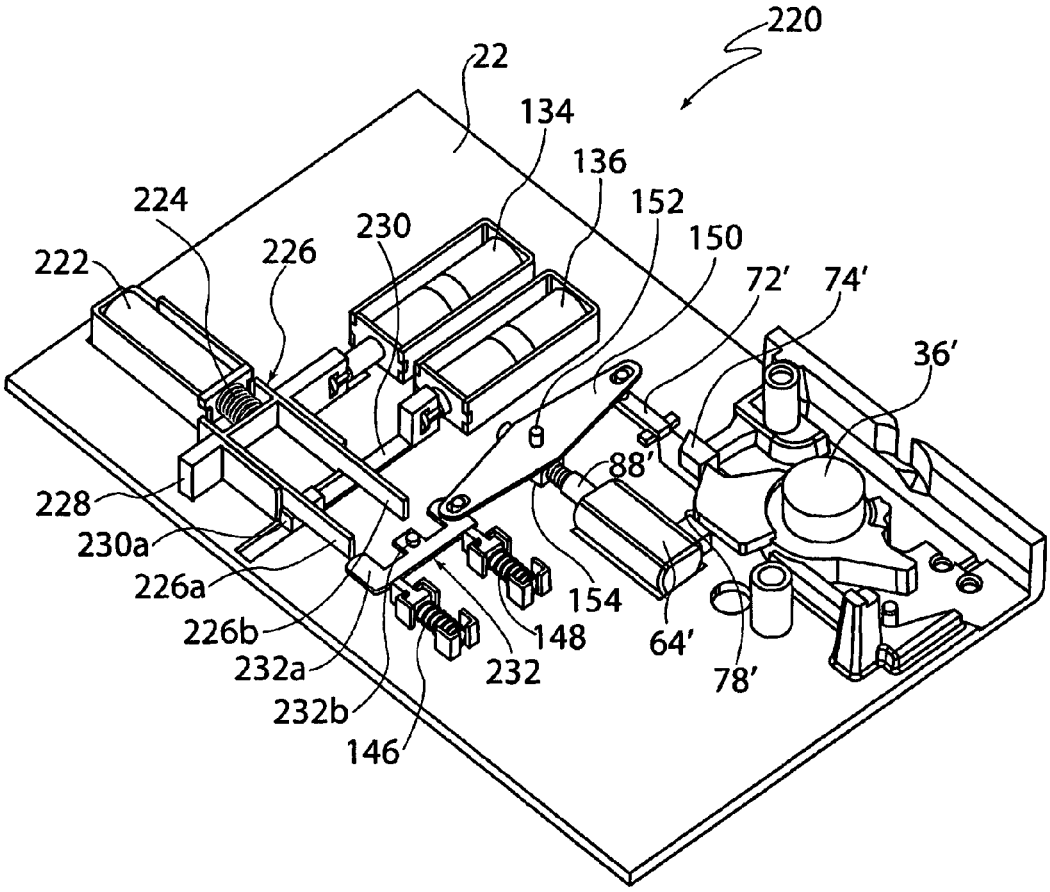
FIG. 22 is a partial perspective view of a third embodiment of a lock assembly in an unlocked configuration.

The operation of the lock assembly 220 shall now be described. FIG. 22 shows the lock assembly 220 unlocked with the protuberances 74' and 78' not in abutting engagement and the second hub 36' thus being pivotable for bolt retraction. The lock assembly 220 is unable to fail to a locked condition, in response to a power failure or an energy release signal, with its components positioned as shown.

Figure 23:
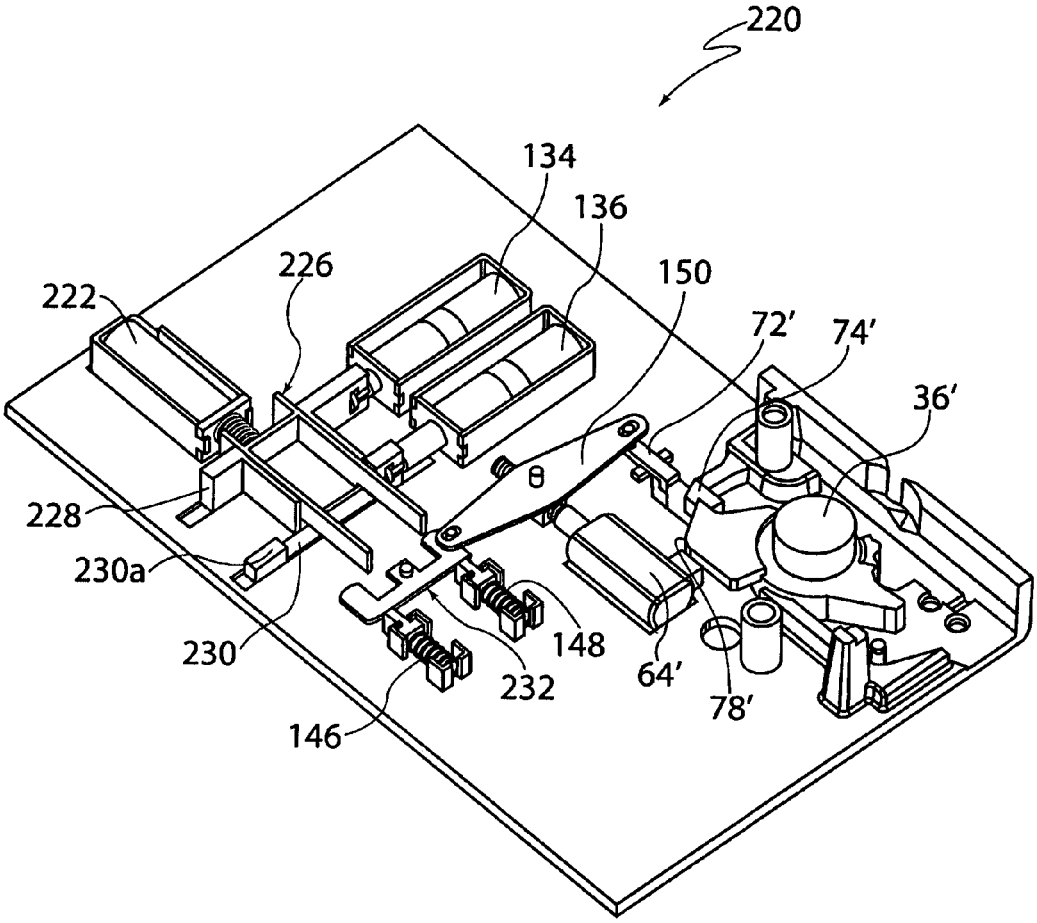
FIG. 23 is a partial perspective view of the lock assembly of FIG. 22 set fail safe and locked.

FIG. 23 shows the lock assembly 220 locked and set to failsafe. The solenoid 222 is energised and thus the driver 226 is retracted. The motor 64' has been driven to lower the boss 152 and thus pivot the rocker 150 clockwise. This lowers the hub locker 72' and places the protuberances 74' and 78' in abutting engagement. The second hub 36' is thus not able to be pivoted for bolt retraction. The solenoid 134 is retracted with the slider 228 thus positioning the driver 226 in the rearward position, with the leg 232*b* aligned with the extension 232*b*. The solenoid 136 is extended to drive the slider 230 to the forward position, in which the protuberance 230*a* does not prevent movement of the driver 226.

Figure 24:
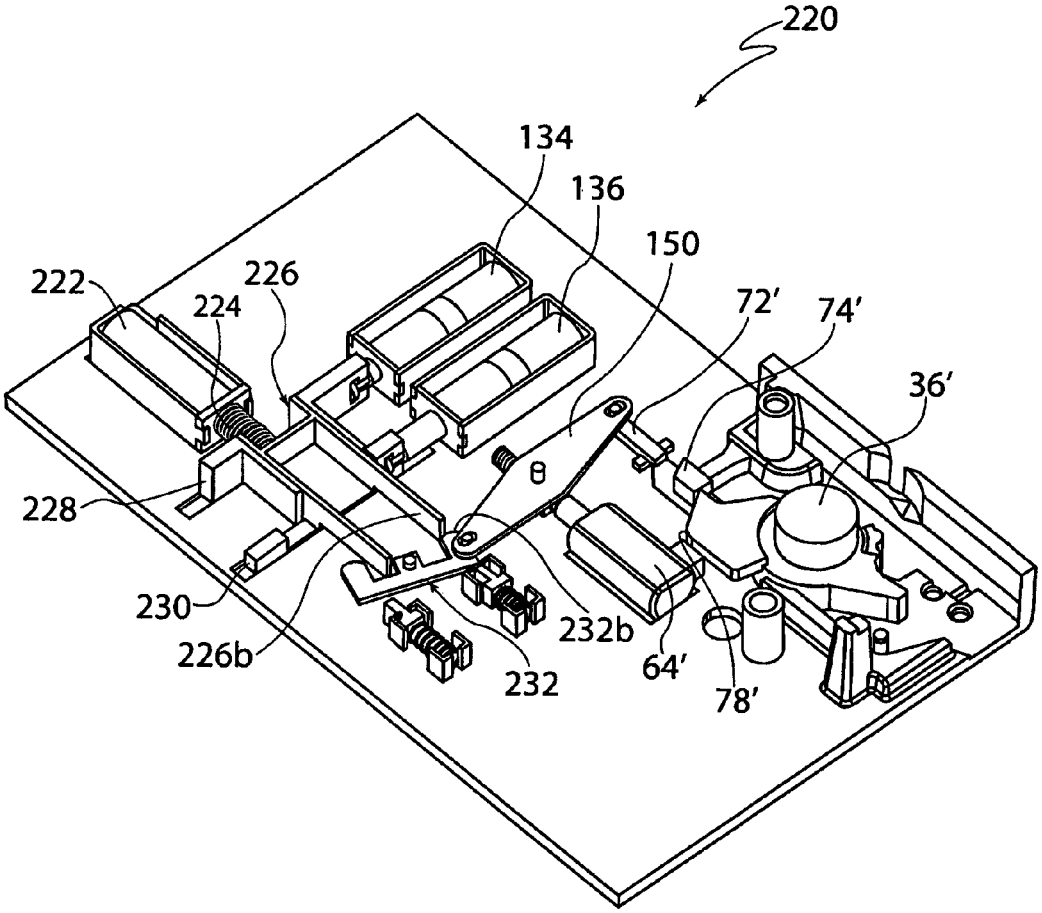
FIG. 24 is a partial perspective view of the lock assembly of FIG. 23 after movement to an unlocked configuration.

FIG. 24 shows the lock assembly 220 of FIG. 23 after a power failure (or the supply of an energy release signal thereto). As the solenoid 222 is no longer energised, the driver 226 is driven downward under the influence of the spring 224. The leg 226*b* contacts the extension 232*b* and pivots the rocker 232 in a clockwise direction. This causes the rocker 150 to pivot in an anti-clockwise direction which raises the hub locker 72' to a position where there is no abutting engagement between the protuberances 74' and 78'. Accordingly, the hub 36' is now free to pivot and the lock assembly 220 is unlocked.

Figure 25:
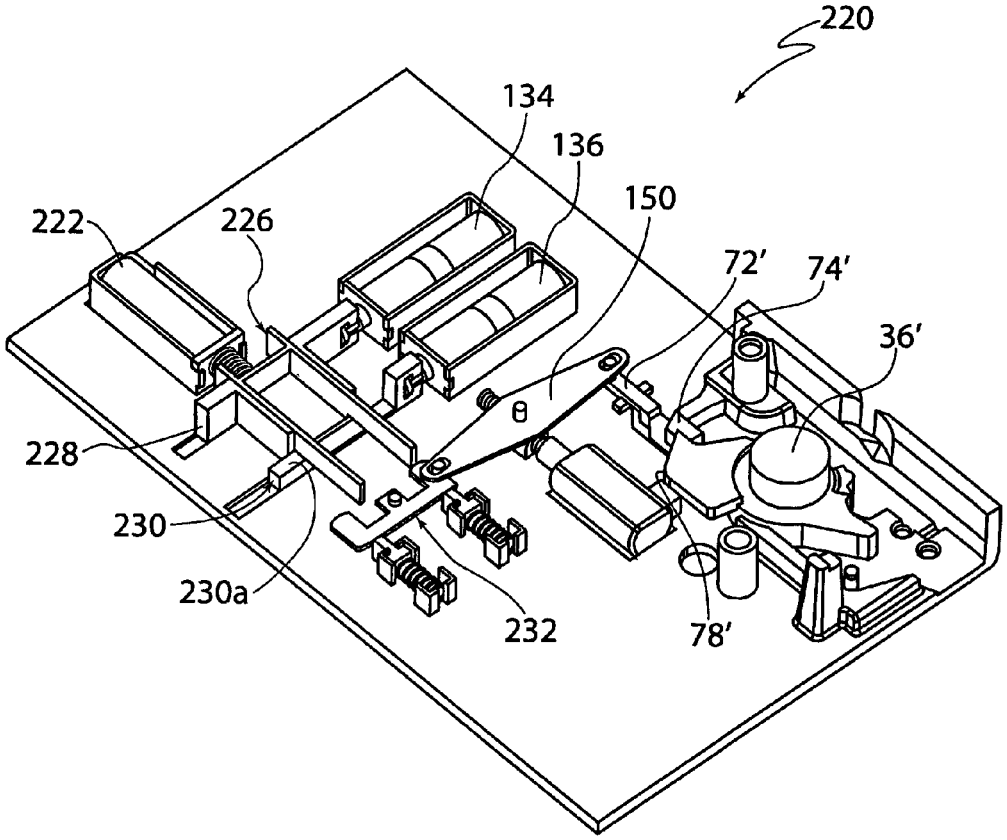
FIG. 25 is a partial perspective view of the lock assembly of FIG. 23 in a locked configuration.

FIG. 25 shows the lock assembly 220 locked (i.e. with the protuberances 74' and 78' in abutting engagement). The solenoid 222 is energised and thus the driver 226 is upwardly retracted. The solenoid 134 is retracted with the slider 228 thus positioning the driver 226 in the rearward position, with the leg 232*b* aligned with the extension 232*b*. The solenoid 136 is retracted with the slider 230 in a rearward position in which the protuberance 230*a* prevents downward movement of the driver 226 by its engagement with the leg 226*a*. As a result, the lock assembly 220 is unable to be unlocked by a power failure or energy release signal.

Figure 26:
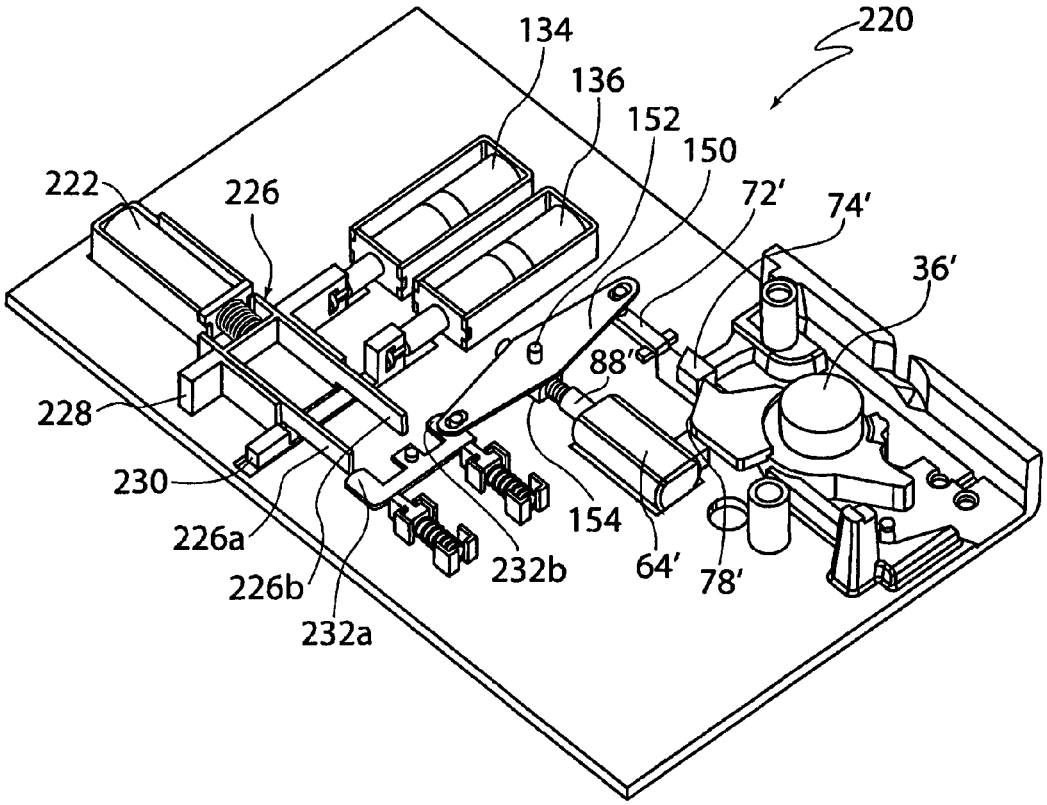
FIG. 26 is a partial perspective view of the lock assembly of FIG. 25 set to fail secure and unlocked.

FIG. 26 shows the lock assembly 222 unlocked by the raising of the boss 152 by the motor 64' which pivots the rocker 150 in an anti-clockwise direction and raises the hub locker 72'. As a result, there is no abutting engagement between the protuberances 74' and 78'. The solenoid 134 is extended to position the slider 228 in the forward position, aligning the leg 226*a* with the extension 232*a*. The solenoid 136 is extended to position the slider 230 in the forward position, where the blocker 230*a* is not able to prevent movement of the leg 226*a*. This places the lock assembly 220 in a failsecure setting.

Figure 27:
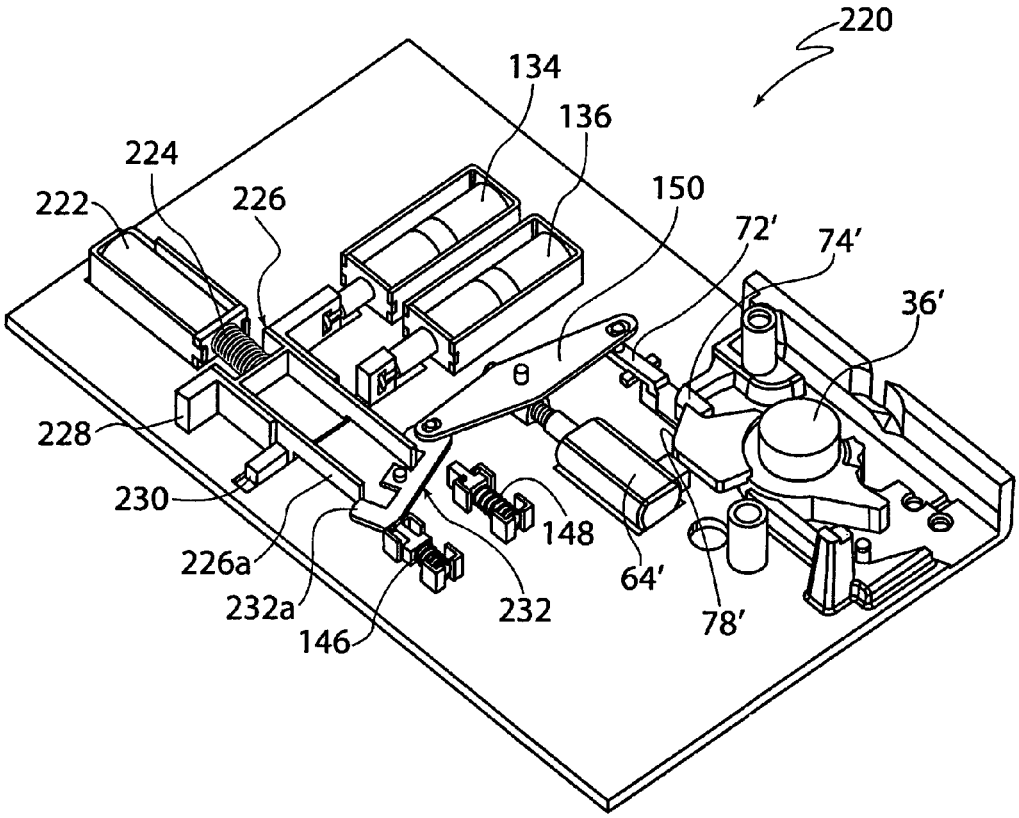
FIG. 27 is a partial perspective view of the lock assembly of FIG. 26 after movement to a locked configuration.

FIG. 27 shows the lock assembly 220 of FIG. 26 after a power failure (or the supply of an energy release signal thereto). As the solenoid 222 is no longer energised, the driver 226 is driven downwardly under the influence of the spring 224. This drives the leg 226*a* against the extension 232*a* and causes the rocker 232 to pivot in an anti-clockwise direction. This movement in turn pivots the rocker 150 in a clockwise direction and drives the hub locker 72' downwards such that the protuberances 74' and 78' are in abutting engagement. This locks the hub 36'.

As with the lock assembly 120, the lock assembly 220 can advantageously be set to failsecure, set to failsafe, locked and unlocked by (remote or local) electrical signal, as the previously described sequences of operations are all brought about by manipulation of electrical powered/controlled components.

FIGS. 28 to 33 shows a fourth embodiment of an electrically controllable and electrically powered mortise lock assembly 320. The lock assembly 320 has several components in common with the previously described lock assemblies 120 and 220 which are indicated with like reference numerals.

The lock assembly 320 includes a single pull type solenoid 322 with flange 322*a* and a biasing spring 324. The solenoid 322 acts upon a L-shaped driver 326, which has end 326*a* mounted to the housing 22 at pivot 327. The driver 326 is biased upwardly by a spring 328. The lock assembly 320 also includes a double acting solenoid 330 which acts upon one end of a L-shaped rocker 332, which is pivotally mounted to the housing at pivot 333. The other end of the rocker 332 acts upon a locking slider 334.

Figure 28:
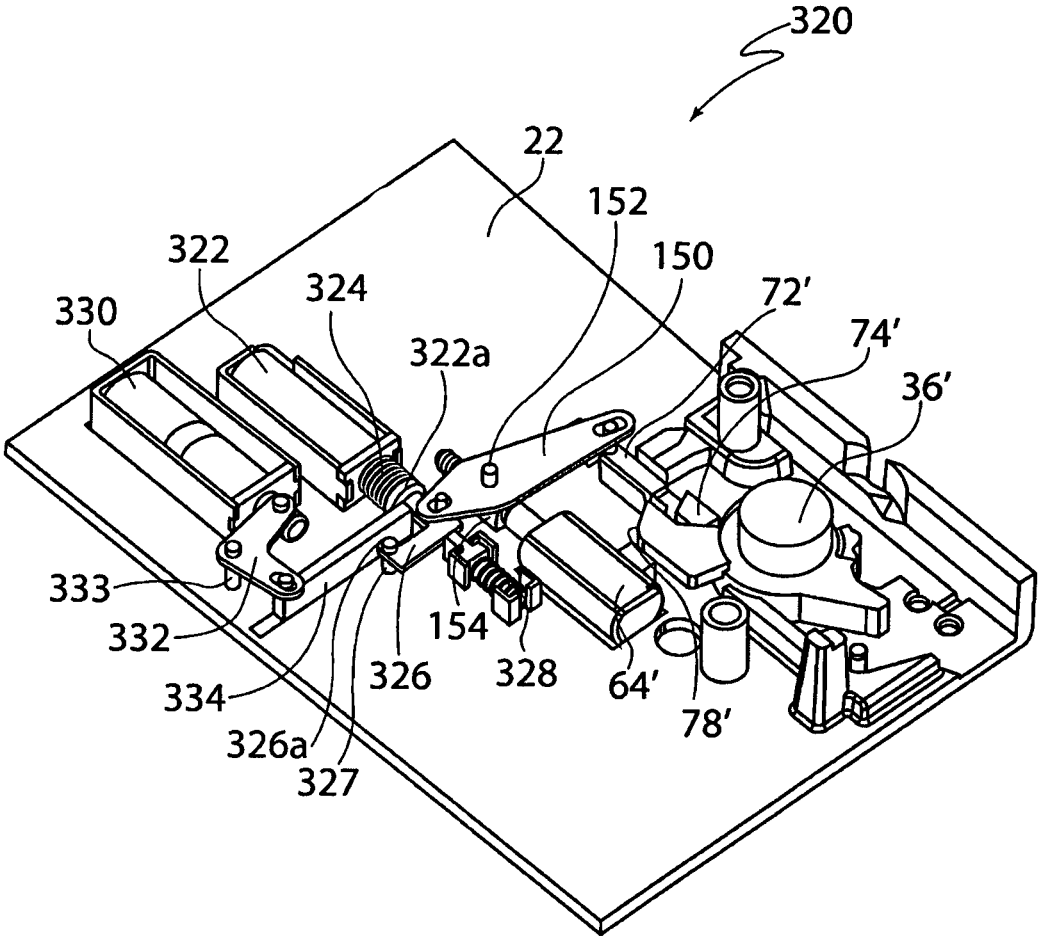
FIG. 28 is a partial perspective view of a fourth embodiment of a lock assembly in an unlocked configuration.

The operation of the lock assembly 320 shall now be described. FIG. 28 shows the lock assembly 320 unlocked with the protuberances 74' and 78' not in abutting engagement. More particularly, the protuberance 74' is below the protuberance 78' and the second hub 36' is thus able to be pivotted for bolt retraction. The lock assembly 320 is unable to fail to a locked condition, in response to a power failure or an energy release signal, with the components positioned as shown.

Figure 29:
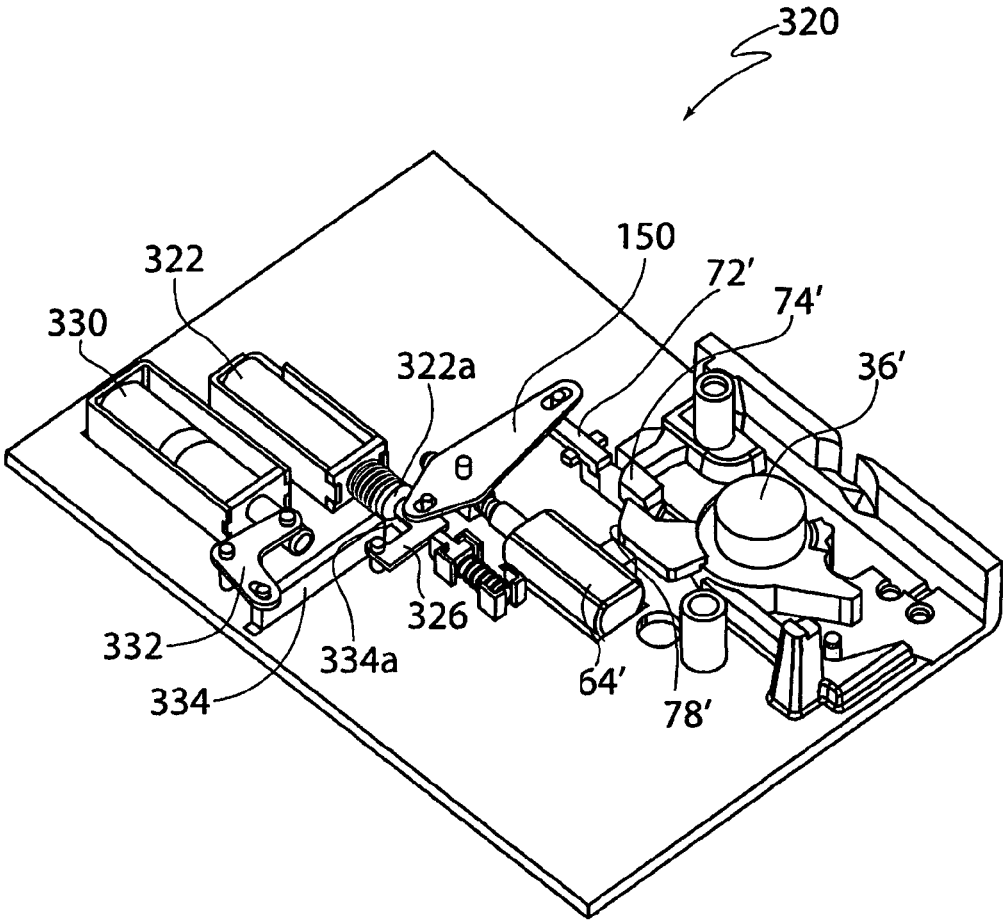
FIG. 29 is a partial perspective view of the lock assembly of FIG. 28 set to fail safe and unlocked.

FIG. 29 shows the lock assembly 320 locked and set to failsafe. Solenoid 322 is energised and retracted, placing the driver 326 in an upper position. The solenoid 330 is extended to drive the slider 334 to a forward position, in which end 334*a* of the slider 334 does not prevent movement of the flange 322*a*. The threaded part 154 has also been driven upwardly away from the motor 64', causing the rocker 150 to pivot in an anti-clockwise direction and raise the hub-locker 72'. This positions the protuberances 74' and 78' in abutting engagement, thereby locking the hub 36' against pivotal movement.

Figure 30:
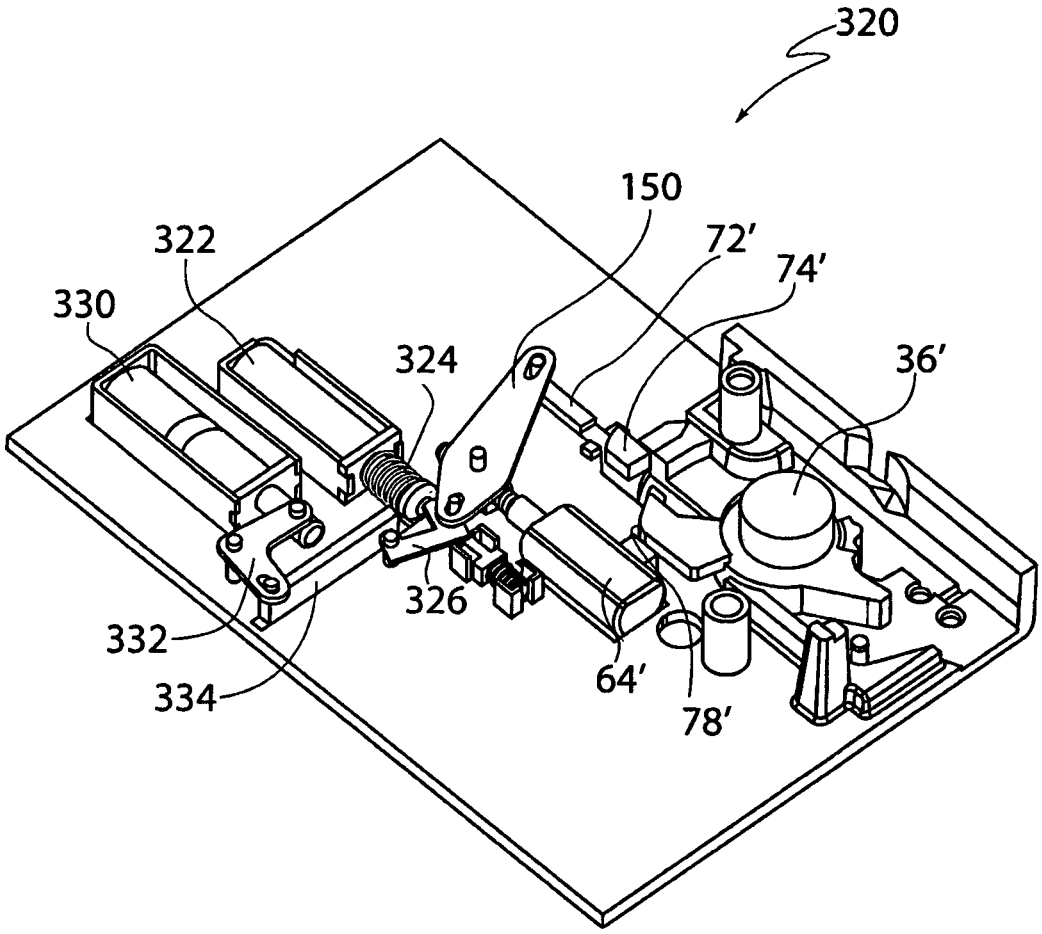
FIG. 30 is a partial perspective view of the lock assembly of FIG. 29 after movement to an unlocked configuration.

FIG. 30 shows the lock assembly 320 of FIG. 29 after a power failure (or the supply of an energy release signal thereto). As the solenoid 322 is no longer energised, the driver 326 is driven downwardly under the influence of spring 324. This causes the rocker 150 to pivot in an anti-clockwise direction which raises the hub locker 72' to a position where there is no abutting engagement between the protuberances 74' and 78'. More particularly, the protuberance 74' is positioned above the protuberance 78'. Accordingly, the hub 36' is now free to pivot and the lock assembly 320 is unlocked.

Figure 31:
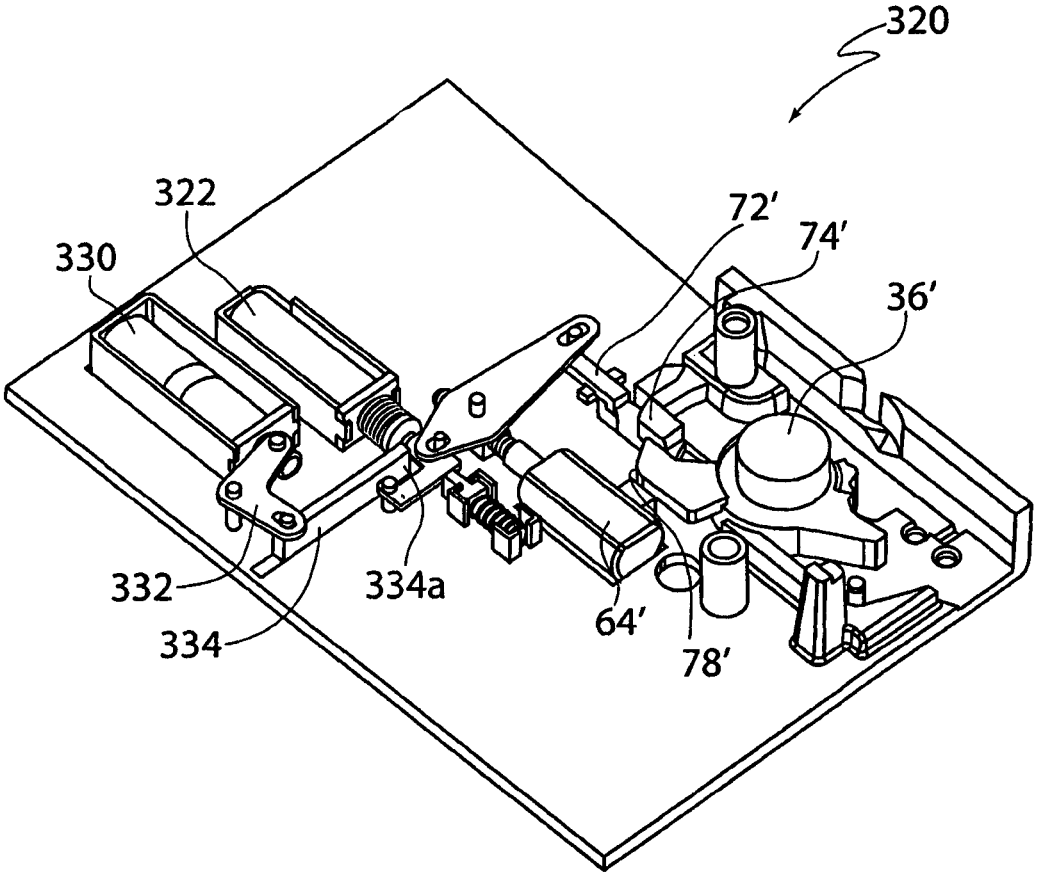
FIG. 31 is a partial perspective view of the lock assembly of FIG. 28 in a locked configuration.

FIG. 31 shows the lock assembly 320 locked (i.e. with the protuberances 74' and 78' in abutting engagement). The solenoid 322 is energised and thus the driver 326 is upwardly retracted. The solenoid 330 is also retracted which causes the rocker 332 to position the slider 334 rearwardly and in a position with the end 334*a* overlapping with the flange 322*a* and thereby blocking movement of the driver 326. As a result, the lock assembly 320 is unable to be unlocked by a power failure or an energy release signal.

Figure 32:
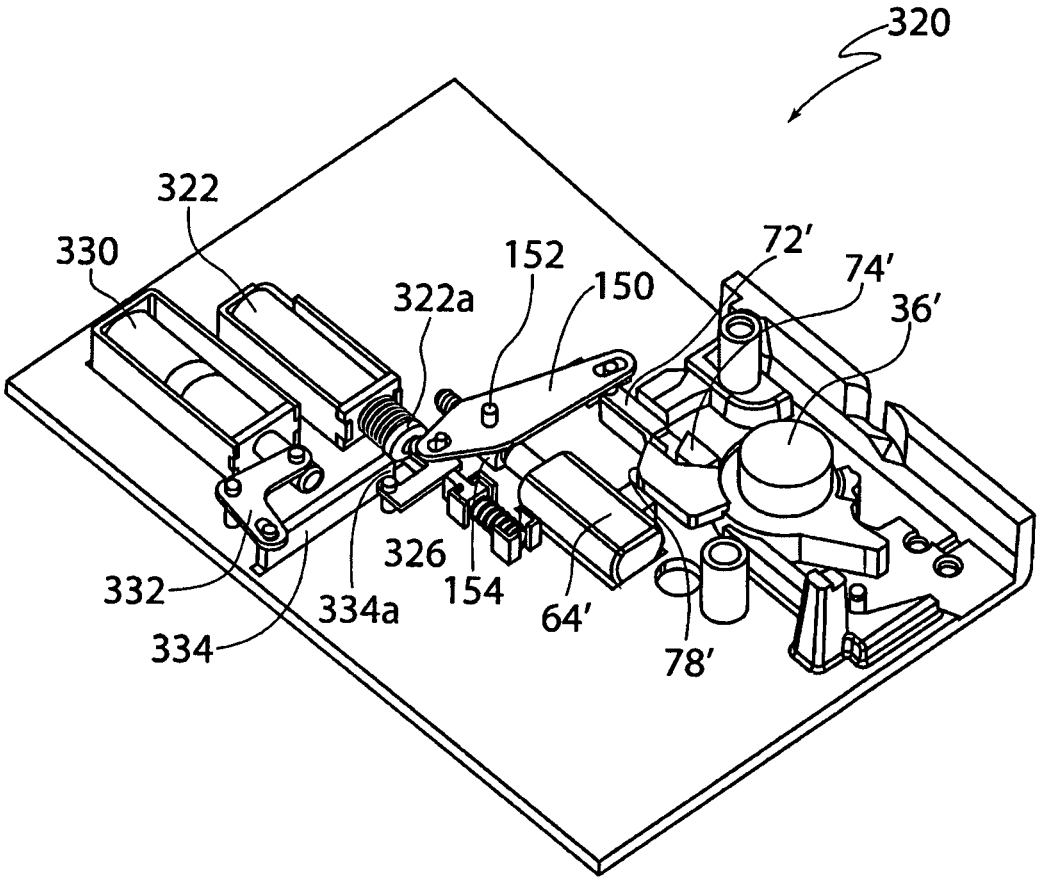
FIG. 32 is a partial perspective view of the lock assembly of FIG. 31 set to fail secure and unlocked.

FIG. 32 shows the lock assembly 320 unlocked by the lowering of the threaded part 154 and the boss 152 by the motor 64', which pivots the rocker 150 in a clockwise direction and lowers the hub locker 72'. As a result, there is no abutting engagement between the protuberances 74' and 78' as the protuberance 74' is beneath the protuberance 78'. The solenoid 322 is energised to position the driver 326 in a raised position. The solenoid 330 is extended the position the slider 334 such that the end 334*a* does not restrict movement of the flange 322*a*. This places the lock assembly 320 in a fail secure setting.

Figure 33:
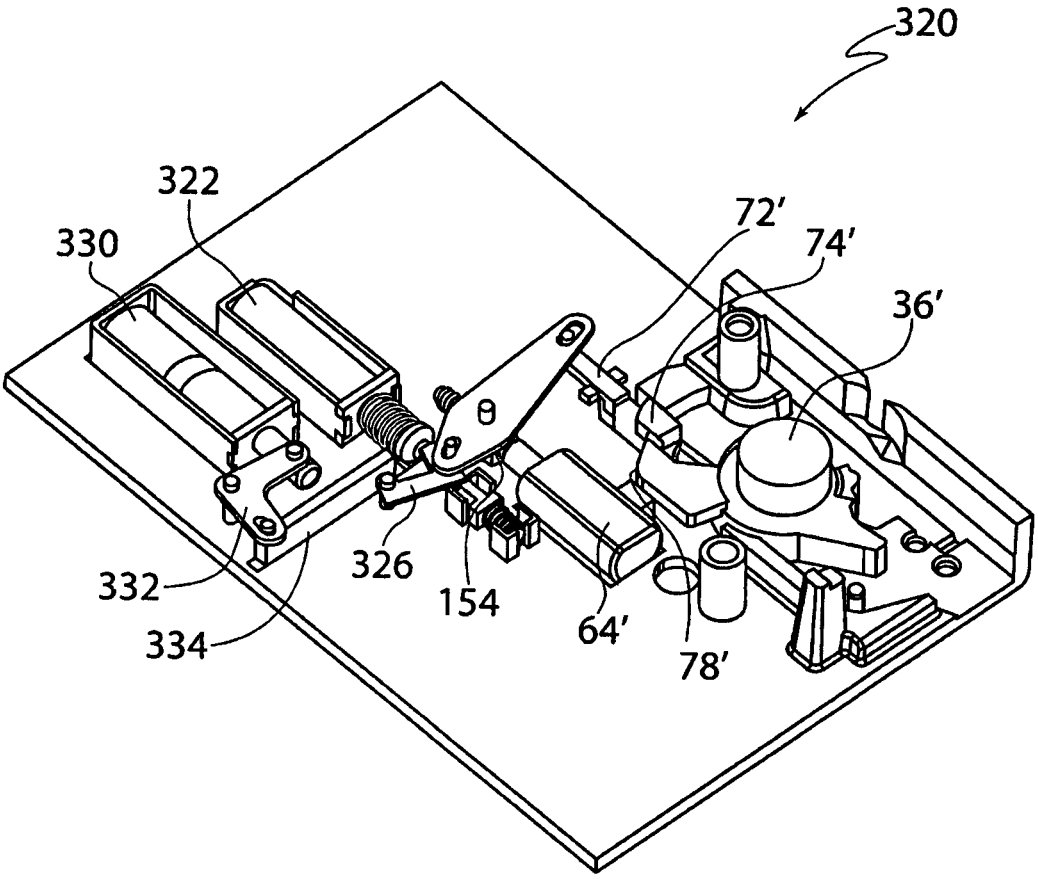
FIG. 33 is a partial perspective view of the lock assembly of FIG. 31 after movement to a locked configuration.

FIG. 33 shows the lock assembly 320 of FIG. 32 after a power failure (or the supply of an energy release signal thereto). As the solenoid 322 is no longer energised, the driver 326 is driven downwardly under the influence of the spring 324. This movement in turn pivots the rocker 150 in an anti-clockwise direction and raises the hub locker 72' such that the protuberances 74' and 78' are in abutting engagement. This locks the hub 36'.

As with the previously described lock assemblies, the lock assembly 320 can advantageously be set to failsecure, set to failsafe, locked and unlocked by (remote or local) electrical signal, as the previously described sequences of operations are all brought about by manipulation of electrical powered/controlled components.

Although the invention has been described with reference to preferred embodiments, it will be appreciated by persons skilled in the art that the invention can be embodied in many other forms. For example, the energy storage means in the above embodiments receive electrical energy, convert the received electrical energy to mechanical energy and store the mechanical energy (in the form of spring compression). However, in other embodiments (not shown), the energy storage means receive electrical energy and store electrical energy in one or more condensors.

The invention claimed is:

1. A lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure; and a first remotely controllable, electrically powered setting mechanism adapted to set the first electrically powered hub locker assembly to operate as fail safe in response to a remotely supplied fail safe signal or to operate as fail secure in response to a remotely supplied fail secure signal.

2. The lock assembly as claimed in claim 1, wherein the remotely supplied fail safe signal and the remotely supplied fail secure signal are supplied to the first remotely controllable, electrically powered setting mechanism in the form of an electrical signal, a lack of an electrical signal, a fibre optic signal, a lack of a fibre optic signal, electromagnetic radiation or lack of electromagnetic radiation.

3. The lock assembly as claimed in claim 1 wherein the lock assembly includes a first energy storage means adapted to receive and store energy.

4. The lock assembly as claimed in claim 3, wherein the lock assembly is adapted to release the stored energy in the first energy storage means when power is removed from the lock assembly and use the releasing of the stored energy to drive the first electrically powered hub locker assembly.

5. The lock assembly as claimed in claim 4, wherein the released stored energy is used to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

6. The lock assembly as claimed in claim 3, wherein the lock assembly is adapted to release the stored energy in the first energy storage means in response to an energy release signal and use the released stored energy to drive the first electrically powered hub locker assembly.

7. The lock assembly as claimed in claim 3, wherein the first energy storage means is adapted to receive mechanical energy and store mechanical energy.

8. The lock assembly as claimed in claim 3, wherein the first energy storage means is adapted to receive electrical energy, convert the received electrical energy to mechanical energy and store mechanical energy.

9. The lock assembly as claimed in claim 3, wherein the first energy storage means includes a spring and the first remotely controllable, electrically powered setting mechanism includes a first driver able to compress the spring.

10. The lock assembly as claimed in claim 3, wherein the first energy storage means includes two springs and the first remotely controllable, electrically powered setting mechanism includes a first driver able to selectively compress one of the two springs.

11. A lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure;

a first energy storage means adapted to receive and store energy; and a first controllable, electrically powered setting mechanism adapted to set the first electrically powered hub locker assembly to operate as fail safe in response to fail safe signal or to operate as fail secure in response to a fail secure signal, wherein the first electrically powered hub locker assembly is drivable in the absence of power, using the energy stored in the first energy storage means, to a position preventing movement of the first hub in response to torque being applied to, or movement of, the first handle when set to operate as fail secure or to a position allowing movement of the first hub in response to torque being applied to, or movement of, the first handle when set to operate as fail safe.

12. The lock assembly as claimed in claim 11, wherein the first controllable, electrically powered setting mechanism is adapted to set the first electrically powered hub locker assembly to operate as fail safe in response to a remotely supplied fail safe signal or to operate as fail secure in response to a remotely supplied fail secure signal.

13. The lock assembly as claimed in claim 11, wherein the remotely supplied fail safe signal and the remotely supplied fail secure signal are supplied to the first remotely controllable, electrically powered setting mechanism in the form of an electrical signal, a lack of an electrical signal, a fibre optic signal, a lack of a fibre optic signal, electromagnetic radiation, lack of electromagnetic radiation or other.

14. The lock assembly as claimed in claim 11, wherein the lock assembly is adapted to release the stored energy in the first energy storage means when power is removed from the lock assembly and use the releasing of the stored energy to drive the first electrically powered hub locker assembly.

15. The lock assembly as claimed in claim 14, wherein the released stored energy is used to drive the first electrically powered hub locker assembly to a position preventing movement of the first hub in response to torque being applied to, or movement of, the first handle when set to operate as fail secure or to a position allowing movement of the first hub in response to torque being applied to, or movement of, the first handle when set to operate as fail safe.

16. The lock assembly as claimed in claim 11, wherein the lock assembly is adapted to release the stored energy in the first energy storage means in response to an energy release signal and use the released stored energy to drive the first electrically powered hub locker assembly.

17. The lock assembly as claimed in claim 11, wherein the first energy storage means is adapted to receive mechanical energy and store mechanical energy.

18. The lock assembly as claimed in claim 11, wherein the first energy storage means is adapted to receive electrical energy, convert the received electrical energy to mechanical energy and store mechanical energy.

19. A lock assembly including:

a lock bolt movable between a latching position and an unlatching position;

a first hub adapted to move the lock bolt in response to torque being applied to, or movement of, a first handle;

a first electrically powered hub locker assembly settable to operate as fail safe or fail secure;

a first controllable, electrically powered setting mechanism adapted to set the first electrically powered first hub locker assembly to operate as fail safe in response to a fail safe signal or to operate as fail secure in response to a fail secure signal;

a first fail safe energy storage means; and a first fail secure energy storage means, wherein, when the first electrically powered hub locker assembly is set to operate as fail safe, the first electrically powered hub locker assembly is drivable using energy stored in the first fail safe energy storage means to a position allowing movement of the first hub in response to torque being applied to, or movement of, the first handle, and when the first electrically powered hub locker assembly is set to operate as fail secure, the first electrically powered hub locker assembly is drivable using energy stored in the first fail secure energy storage means to a position preventing movement of the first hub in response to torque being applied to, or movement of, the first handle.

20. The lock assembly as claimed in claim 19, wherein the lock assembly is adapted to release the stored energy in the first fail safe energy storage means or in the first fail secure energy storage means when power is removed from the lock assembly and use the released stored energy to drive the first electrically powered hub locker assembly.

21. The lock assembly as claimed in claim 19, wherein the lock assembly is adapted to release the stored energy in the first fail safe energy storage means or in the first fail secure energy storage means in response to an energy release signal and use the released stored energy to drive the first electrically powered hub locker assembly.

22. The lock assembly as claimed in claim 19, wherein the first controllable, electrically powered setting mechanism is adapted to set the first electrically powered hub locker assembly to operate as fail safe in response to a remotely supplied fail safe signal or to operate as fail secure in response to a remotely supplied fail secure signal.

23. The lock assembly as claimed in claim 19, wherein energy is receivable and storable in one of the first fail safe energy storage means or the first fail secure energy storage means.

24. The lock assembly as claimed in claim 19, wherein energy is receivable and storable in both of the first fail safe energy storage means and the first fail secure energy storage means.

* * * * *